US010323341B2

(12) United States Patent
Tone et al.

(10) Patent No.: US 10,323,341 B2
(45) Date of Patent: Jun. 18, 2019

(54) HIGHLY AIR-PERMEABLE WOVEN FABRIC RESISTANT TO WASHING

(71) Applicant: TOYOBO STC CO., LTD., Osaka (JP)

(72) Inventors: Hajime Tone, Osaka (JP); Tadato Onodera, Osaka (JP); Hideki Kawabata, Osaka (JP)

(73) Assignee: TOYOBO STC CO., LTD., Osaka (JP)

( * ) Notice: Subject to any disclaimer, the term of this patent is extended or adjusted under 35 U.S.C. 154(b) by 42 days.

(21) Appl. No.: 15/618,864

(22) Filed: Jun. 9, 2017

(65) Prior Publication Data

US 2017/0356105 A1 Dec. 14, 2017

(30) Foreign Application Priority Data

Jun. 10, 2016 (JP) ..... 2016-116515

(51) Int. Cl.

| | |
|---|---|
| ***D03D 13/00*** | (2006.01) |
| ***A41D 3/02*** | (2006.01) |
| ***D03D 1/00*** | (2006.01) |
| ***D03D 15/00*** | (2006.01) |

(52) U.S. Cl.

CPC ..... *D03D 13/008* (2013.01); *A41D 3/02* (2013.01); *D03D 1/00* (2013.01); *D03D 15/0083* (2013.01)

(58) Field of Classification Search

None

See application file for complete search history.

(56) References Cited

U.S. PATENT DOCUMENTS

2005/0202741 A1* 9/2005 Onodera ..... D03D 1/007 442/189

2012/0183754 A1 7/2012 Kitagawa et al.

2013/0035014 A1* 2/2013 Tone ..... D03D 13/008 442/189

FOREIGN PATENT DOCUMENTS

| | | |
|---|---|---|
| JP | 4-245952 | 9/1992 |
| JP | 5714811 | 5/2015 |
| JP | 5849141 | 1/2016 |

OTHER PUBLICATIONS

Japanese Office Action, dated Oct. 23, 2018 in corresponding Japanese patent application No. 2016-116515.

* cited by examiner

*Primary Examiner* — Shawn Mckinnon

(74) *Attorney, Agent, or Firm* — Wenderoth, Lind & Ponack, L.L.P.

(57) ABSTRACT

An object of the present invention is to provide a highly air-permeable woven fabric whose air permeability does not easily deteriorate even after repetitive washing and which has a good fabric quality. The woven fabric of the present invention comprises warp threads constituted by substantially quadrilateral shaped filaments and weft threads constituted by substantially quadrilateral shaped filaments. The warp threads and the weft threads overlap each other in an alternating manner forming crossover points comprising front threads and back threads, such that the warp threads and the weft threads alternate constituting the front threads. The crossover points comprise first crossover points and second crossover points. The first crossover points are the crossover points where the substantially quadrilateral shaped filaments constituting the front threads are aligned in a line. The second crossover points are the crossover points where at least 60% of the substantially quadrilateral shaped filaments constituting the front threads are aligned in a line. The rest of the substantially quadrilateral shaped filaments constituting the front threads overlap above and below in a thickness direction of the woven fabric, wherein, in a structure constituting five warp threads, six weft threads, and 30 crossover points, the total number of the first crossover points among thirty crossover points is not less than 10% and not more than 90%.

11 Claims, 14 Drawing Sheets

(a)

(b)

(c)

(a)

(b)

(c)

(a)

(b)

(c)

(d)

(e)

(a)

(b)

(c)

HIGHLY AIR-PERMEABLE WOVEN FABRIC RESISTANT TO WASHING

CROSS REFERENCE TO RELATED APPLICATIONS

The present application claims priority to Japanese Patent Application No. 2016-116515 filed on Jun. 10, 2016, the entire contents of which are incorporated herein by reference.

TECHNICAL FIELD

The present invention relates to a woven fabric that maintains moderate windproof property but that does not easily become damp even after sweating, which is preferable for use as an outer fabric of a windbreaker or a down product suitable for outdoor, sport, and casual uses. In particular, the present invention relates to a woven fabric that can maintain stable air permeability even after being rubbed externally by washing or the like.

BACKGROUND OF THE INVENTION

Jackets, such as windbreakers, sleeping bags for outdoor uses, including hillwalking and hiking, and blousons and coats for town uses, employ woven fabrics with windproof, down-proof, heat-retaining, and lightweight properties. These woven fabrics are usually produced to have air permeability of not more than 1.5 cc/cm$^2$/s.

In recent years, fewer down products use feathers as a filling, in view of animal protection and environmental conservation. Instead, more resin fillings, such as polyester-based, polyolefin-based, or polyphenyl sulfide-based resins, are used. However, the materials used in the resin fillings have poor moisture absorbency by nature and thus, it is difficult to eliminate a damp feeling after sweating as compared to feathers. Furthermore, the resin fillings do not easily allow the fillings to pass through the outer fabric as compared to feathers (hereinafter, a property that the fillings are difficult to pass through is also called "downproof property"). Accordingly, it is not necessary for the air permeability of the outer fabric to be as low as for feathers. Therefore, the outer fabric of a down product containing a resin filling has been required to have increased air permeability to suppress the damp feeling after sweating to some extent.

A highly air-permeable woven fabric is disclosed in, for example, Patent Document 1. Patent Document 1 proposes a woven fabric that has through-holes extending from the front side of the fibers to the back side of the fibers. However, since each of these through-holes is formed as a result that at least a part of the crossover point between warp and weft threads is melted, the through-holes are so large that they are visible to the naked eye and a sufficient downproof property is not demonstrated. In addition, since each of the holes is formed by melting a part of the crossover point, the production of the woven fabric has a high cost and is not suitable for industrial production.

Furthermore, when filaments constituting the woven fabric are displaced from each other when they are rubbed during, for example, washing, the portion in which the filaments are displaced from each other has high air permeability and this may reduce the windproof property and the downproof property of the cloth. Therefore, woven fabrics for the above uses are required to have a property where air permeability does not easily increase even after washing. An example of solving such a problem is shown in Patent Document 2, which discloses a method for producing a down-proof woven fabric obtained by calendering a cloth on one side and thereafter coating a non-solvent urethane resin on at least the other side of the cloth. However, since the woven fabric obtained according to Patent Document 2 is coated with resin, there is a problem in that this method cannot increase the air permeability of the woven fabric.

PRIOR ART DOCUMENTS

Patent Documents

Patent Document 1: JP 5714811 B1
Patent Document 2: JP 5849141 B1

BRIEF SUMMARY OF THE INVENTION

Problems to be Solved by the Invention

In order to provide a highly air-permeable woven fabric for outer fabrics, the inventors of the present invention conducted a study on the following two methods.

Method 1: Reduce a fiber density and employ high multi-filament(s) (i.e., a multifilament composed of monofilaments having a small fineness)

Method 2: Relax the conditions (such as pressure, temperature, and speed) of calendering In Method 1, a highly air-permeable woven fabric was obtained because the fiber density was reduced. However, since the fiber density is low, the displacement of filaments became large and distortion and slippage of filaments occurred. Thus, the quality of the cloth significantly decreased.

Method 2 is inspired by a method of producing conventional products (poorly air-permeable woven fabrics). Since the conditions of calendering were relaxed, the gaps between filaments were not completely closed. Thus, the gaps between filaments which had been formed during the production of the woven fabric were kept, and the air permeability of the woven fabric improved. However, since the filaments were not fixed, the filaments are easily displaced from each other when, for example, they were rubbed during washing and, therefore, the original air permeability was not maintained after washing. In particular, in the case where a filament has a circular cross section, the filaments were displaced from each other (rolled over each other) significantly. Furthermore, since the conditions of calendering were relaxed, the filaments constituting front threads readily overlap each other in the thickness direction. However, at this second crossover point, the filaments easily become fluffy when they receive external stimulation, thereby causing a new problem of a reduced fabric quality.

An object of the present invention is to provide a highly air-permeable woven fabric whose air permeability does not easily deteriorate even after repetitive washing and which has a good fabric quality.

Solutions to the Problems

The inventors of the present invention have studied extensively to attain the above object. As a result, the inventors have found that, by using substantially quadrilateral shaped filament as filaments constituting a woven fabric, arranging first crossover points and second crossover points in a mixed manner as the arrangement of the filaments, and controlling the state of the arrangement of the substantially quadrilateral shaped filament; it is possible to provide a woven fabric that has high air permeability, that suppresses rolling of the filaments even after repetitive washing, that suppresses a deterioration of air permeability due to the rolling, and that is also excellent in abrasion resistance by making use of the flatness of the substantially quadrilateral shaped filament. Consequently, the inventors have accomplished the present invention.

That is, the woven fabric of the present invention has one or more features described below.

(1) A woven fabric comprising: warp threads constituted by substantially quadrilateral shaped filaments; weft threads constituted by substantially quadrilateral shaped filaments; wherein, the warp threads and the weft threads overlap each other in an alternating manner forming crossover points comprising front threads and back threads, such that the warp threads and the weft threads alternate constituting the front threads; the crossover points comprise first crossover points and second crossover points; the first crossover points are the crossover points where the substantially quadrilateral shaped filaments constituting the front threads are aligned in a line; the second crossover points are the crossover points where at least 60% of the substantially quadrilateral shaped filaments constituting the front threads are aligned in a line, and the rest of the substantially quadrilateral shaped filaments constituting the front threads overlap above and below in a thickness direction of the woven fabric; wherein, in a structure constituting five warp threads, six weft threads, and 30 crossover points, the total number of the first crossover points among thirty crossover points is not less than 10% and not more than 90%.

(2) The woven fabric of according to the above (1), wherein the substantially quadrilateral shaped filaments have a substantially quadrilateral cross section comprising four sides.

(3) The woven fabric according to the above (2), wherein the substantially quadrilateral cross section is a parallelogram wherein each angle in a pair of opposite angles are not less than 30° and not more than 90°.

(4) The woven fabric according to the above (2) or (3), wherein the substantially quadrilateral cross section is a diamond wherein all four sides are equal in length.

(5) The woven fabric according to any of the above (1) to (4), wherein: the substantially quadrilateral shaped filaments have a fineness of not less than 1.0 dtex and not more than 7.0 dtex; the woven fabric comprises synthetic fiber multi-filaments constituted by the substantially quadrilateral shaped filaments; the percentage of the synthetic fiber multi-filaments constituted by the substantially quadrilateral shaped filaments with respect to 100 mass % of the woven fabric is 40 mass % or more; and the synthetic fiber multi-filaments have a total fineness of not less than 5.0 dtex and not more than 40 dtex.

(6) The woven fabric according to any of the above (1) to (5), wherein a cover factor is not less than 1450 and not more than 2400.

(7) The woven fabric according to any of the above (1) to (6), wherein an initial air permeability determined in accordance with the Frazier type method A prescribed in JIS L 1096 8.27.1 is not less than 2.0 $cc/cm^2/s$ and not more than 25 $cc/cm^2/s$.

(8) The woven fabric according to any of the above (1) to (7), wherein a rate of change ($L_{10}/L_0$) of an air permeability determined in accordance with the Frazier type method A prescribed in JIS L 1096 8.27.1 between the initial ($L_0$) and the after ten times washing ($L_{10}$) determined in accordance with JIS L 0217 103 method is not less than 0.8 and not more than 1.8.

(9) The woven fabric according to any of the above (1) to (8), wherein a slipping resistance value under a load of 12 kg in accordance with JIS L 1096 B method is not more than 4.0 mm in each of warp and weft directions.

(10) The woven fabric according to any of the above (1) to (9), wherein an abrasion level after 200 times of abrasion is not lower than level 2.

(11) A windbreaker comprising the woven fabric according to any of the above (1) to (10) as an outer fabric.

(12) A down product comprising the woven fabric according to any of the above (1) to (10) as an outer fabric.

In the present disclosure, front thread means a side portion of a warp thread or a weft thread present in a front surface of a woven fabric, which is exposed to a front of the woven fabric.

Effects of the Invention

The present invention provides a highly air-permeable woven fabric whose air permeability does not easily deteriorate even after repetitive washing and which has a good fabric quality. Therefore, with the use of the woven fabric of the present invention, it is possible to provide windbreakers and down products which suppress dampness due to sweating while achieving a moderate windproof property and downproof property, and which are subject to little slipping deterioration, abrasion, fluffing, and the like.

BRIEF DESCRIPTION OF THE DRAWINGS

FIG. 8-1 is a weave diagram showing an example of rip stop taffeta.

FIG. 8-2 is a weave diagram showing another example of rip stop taffeta.

FIG. 8-3 is a weave diagram showing a further example of rip stop taffeta.

FIG. 8-4 is a weave diagram showing a still further example of rip stop taffeta.

FIG. 10-1 is a schematic diagram of a rubbing fastness tester type II (Gakushin-type).

FIG. 10-2 is a photograph of a side of a hook-and-loop fastener fixed to a friction element.

FIG. 10-3 is a photograph of the top of the hook-and-loop fastener fixed to the friction element.

DETAILED DESCRIPTION OF THE INVENTION

<I. Characteristics of Woven Fabric>

A woven fabric of the present invention includes warp threads constituted by substantially quadrilateral shaped filaments, weft threads constituted by substantially quadrilateral shaped filaments, in which the warp threads and the weft threads overlap each other in an alternating manner forming crossover points comprising front threads and back threads. Usually, weft threads intersect warp threads at a right angle, and when the woven fabric is seen from the front side, the crossover point is identified to be a square in which the warp threads and the weft threads overlap each other.

Figure 1:
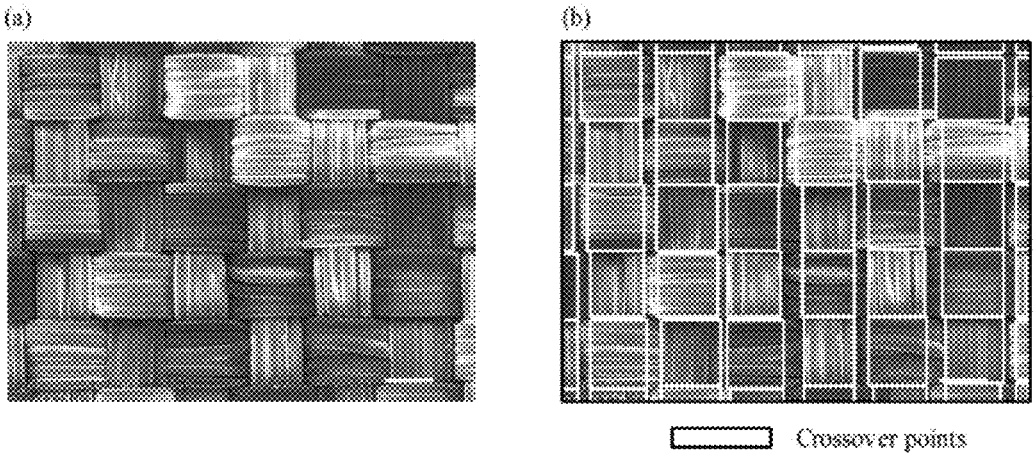
FIG. 1 shows diagrams illustrating crossover points.

FIG. 1 shows views illustrating crossover points. FIG. 1(*a*) is an SEM photograph of the front surface of a woven fabric of the present invention (at a magnification of 120 times), and FIG. 1(*b*) shows crossover points on the photograph. In FIG. 1(*b*). 30 crossover points included in a structure comprising five warp threads and six weft threads are observed. (It should be noted, however, that the crossover points which are only partly shown are not counted).

A woven fabric of the present invention has crossover points where the substantially quadrilateral shaped filaments constituting the front threads are aligned in a line (first crossover points) and crossover points where not less than 60% (more preferably not less than 65%, and even more preferably not less than 70%, and preferably less than 100%) of the substantially quadrilateral shaped filaments constituting the front threads are aligned in a line, and the rest of the filaments constituting the front threads overlap above and below in a thickness direction of the woven fabric (second crossover points).

At each first crossover point, the substantially quadrilateral shaped filaments constituting the front threads are aligned in a line. By aligning the substantially quadrilateral shaped filaments in a line, it is possible to block the air from passing through the woven fabric in the thickness direction. Therefore, the first crossover point contributes to a reduction in air permeability of the woven fabric. It is particularly preferable that adjacent substantially quadrilateral shaped filaments be arranged in contact with each other. The reason is as follows. Since the cross section of each filament is a substantially quadrilateral shape; adjacent filaments could contact with each other on their wide surface. Therefore, when adjacent substantially quadrilateral shaped filaments are in close contact with each other, the gaps between the adjacent substantially quadrilateral shaped filaments are narrowed and the air permeability of the woven fabric decreases. Furthermore, an increase in the ratio of the first crossover points is expected to solve a problem of fluffing occurring at the second crossover points.

On the other hand, although not less than half of the substantially quadrilateral shaped filaments constituting the front threads are aligned in a line at each second crossover point, the rest of the substantially quadrilateral shaped filaments overlap the aligned filaments in the thickness direction of the woven fabric. Since some of the substantially quadrilateral shaped filaments overlap the aligned filaments in the thickness direction of the woven fabric at the second crossover point, gaps are formed on both sides of the front thread as compared to the first crossover point and the air passes through more easily. Therefore, the second crossover point contributes to an increase in air permeability of the woven fabric. Furthermore, since some of the substantially quadrilateral shaped filaments overlap the aligned filaments in the thickness direction of the woven fabric at the second crossover point, the substantially quadrilateral shaped filaments could contact with each other on their surface horizontally (in the direction perpendicular to the thickness direction) and vertically (in the thickness direction). Therefore, the friction force between filaments is more enhanced as compared to the first crossover point. Since the friction force between the filaments makes it more difficult for them to move, the second crossover point also contributes to a restriction of displacement of filaments (rolling of filaments) due to external stimuli.

Figure 2:
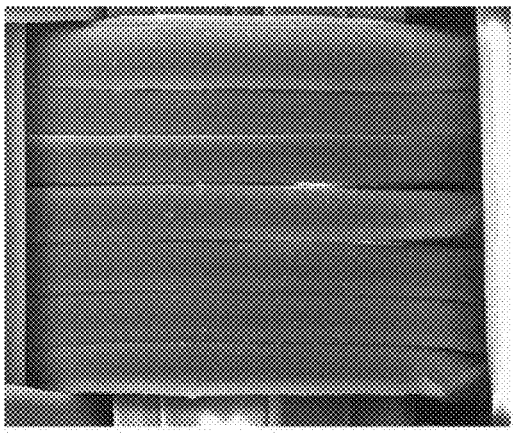
FIG. 2 shows examples of a first crossover point.
Figure 2:
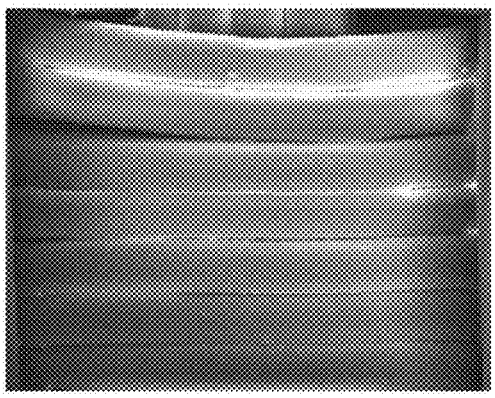
Figure 2:
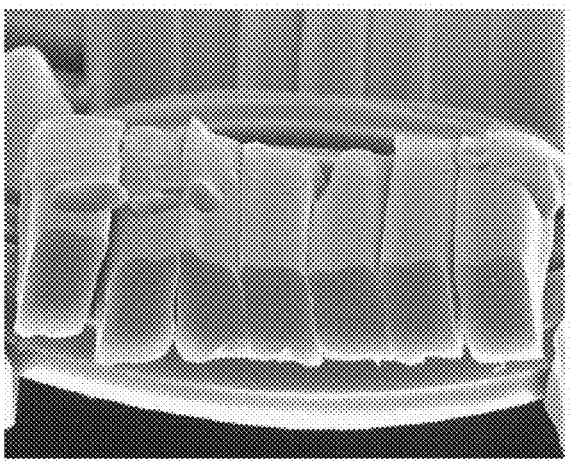

The "first crossover point" more specifically refers to an arrangement where the number of filaments for which at least a part of the exposed surface is confirmed not to be obstructed by another filament at the crossover point is equal to the number of filaments that are actually included in the front threads. FIG. 2 shows an example of the first crossover point. FIGS. 2(*a*) and 2(*b*) are SEM photographs of surfaces of first crossover points. FIG. 2(*a*) shows that all the filaments constituting the front threads are arranged in parallel to each other without overlapping each other. On the other hand, in FIG. 2(*b*), although the top two of the filaments constituting the front threads are somewhat bent, the number of filaments visible in the photograph (7 filaments) is equal to the number of filaments that are actually included in the front threads (7 filaments). Therefore, this example is also included in the first crossover point. Furthermore, FIG. 2(*c*) shows an SEM photograph of a cross section of a first crossover point. As shown in the photograph, at the first crossover point, the filaments included in the front threads are arranged to be in contact with each other.

Figure 3:
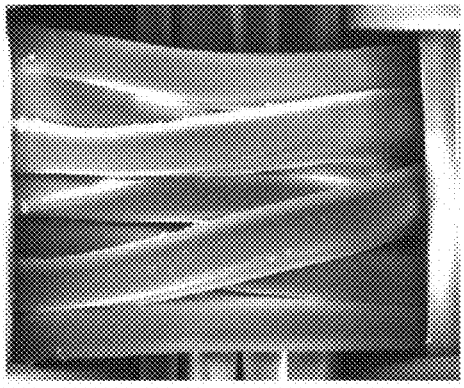
FIG. 3 shows examples of a second crossover point.
Figure 3:
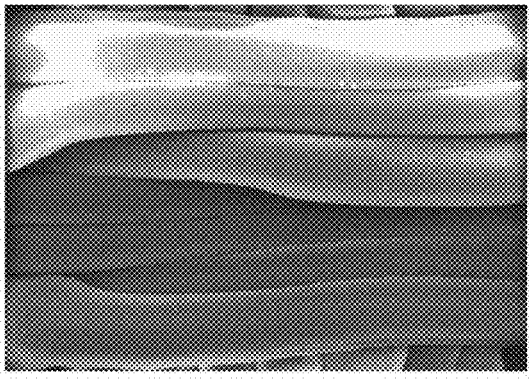
Figure 3:
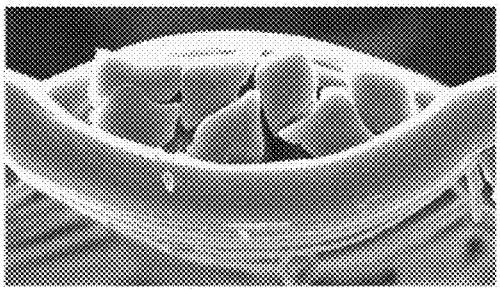
Figure 3:
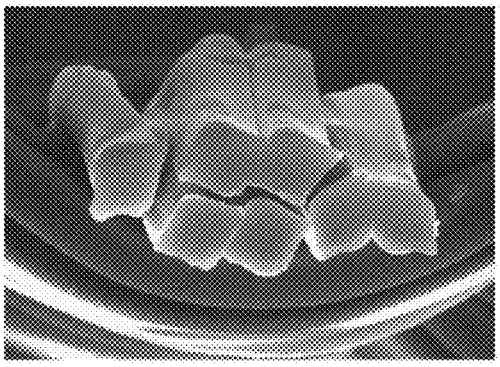
Figure 3:
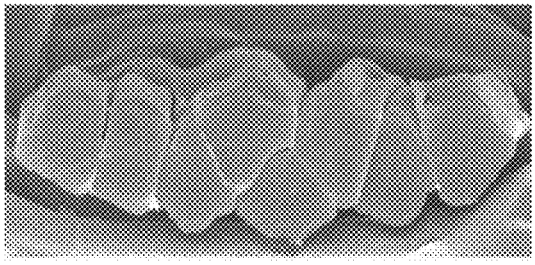

On the other hand, the "second crossover point" more specifically refers to an arrangement where the number of filaments for which at least a part of the exposed surface is confirmed not to be obstructed by another filament at the crossover point is less than the number of filaments that are actually included in the front threads. FIGS. 3(*a*) and 3(*b*) are SEM photographs of surfaces of second crossover points. In both photographs, since two of the seven filaments constituting the front threads overlap aligned filaments in the thickness direction of the woven fabric, these arrangements are categorized as second crossover points. On the other hand, FIGS. 3(*c*) to 3(*e*) show SEM photographs of cross sections of second crossover points. These photographs also show that, at second crossover points, one or two of the seven filaments constituting the front threads overlap the aligned filaments in the thickness direction of the woven fabric.

In a woven fabric of the present invention, the total number of the first crossover points among 30 crossover points included in a structure comprising five warp threads and six weft threads is not less than 10%, preferably not less than 15%, and more preferably not less than 20%, and is not more than 90%, preferably not more than 85%, and more preferably not more than 80%. If the number of the first crossover points is too small, the initial air permeability of the woven fabric would be too high, which is not desirable from the viewpoints of windproof and down-proof properties. If the number of the first crossover points is too large, the initial air permeability of the woven fabric is lowered, which makes it impossible to sufficiently reduce the feeling of stuffiness (discomfort due to moisture) during perspiration. In addition, by controlling the ratio of the first crossover points and that of the second crossover points, rolling of the filaments by external stimuli can be suppressed, resulting in being able to solve the problem of fluffing.

Further, in a woven fabric of the present invention, the total number of the second crossover points among 30 crossover points included in a structure comprising five warp threads and six weft threads is preferably not less than 10%, more preferably not less than 15%, and even more preferably not less than 20%, and is preferably not more than 90%, more preferably not more than 85%, and even more preferably not more than 80%. If the number of the second crossover points is too small, the air permeability of the woven fabric is excessively lowered, thus resulting in a possibility that stuffiness due to perspiration cannot be effectively suppressed, which is not desirable. If the number of the second crossover points is too large, the air permeability of the woven fabric is excessively increased, which is not desirable from the viewpoints of windproof and downproof properties.

In a woven fabric of the present invention after ten times washing, the total number of the first crossover points among 30 crossover points included in a structure comprising five warp threads and six weft threads is preferably not less than 10%, more preferably not less than 15%, and even more preferably not less than 20%, and is preferably not more than 90%, more preferably not more than 85%, and even more preferably not more than 80%. By controlling the ratio of the first crossover points after ten times washing, it is possible to obtain a woven fabric having a moderate windproof property and downproof property.

Further, in a woven fabric of the present invention after ten times washing, the total number of the second crossover points among 30 crossover points included in a structure comprising five warp threads and six weft threads is preferably not less than 10%, more preferably not less than 15%, and even more preferably not less than 20%, and is preferably not more than 90%, more preferably not more than 85%, and even more preferably not more than 80%. By controlling the ratio of the second crossover points after ten times washing, it is possible to obtain a woven fabric that reduces the feeling of stuffiness (discomfort due to moisture).

A woven fabric of the present invention suppresses rolling of the filaments even after repetitive washing, and suppresses a deterioration of air permeability due to the rolling. Therefore, in a woven fabric of the present invention, the increase rate of the occupancy of the second crossover points is hard to increase even after repetitive washing. Specifically, the increase rate of the occupancy of the second crossover points after ten times washing is preferably not more than 19%, more preferably not more than 15%, and even more preferably not more than 12%, and preferably not less than 0%, more preferably not less than 1.5%, even more preferably not less than 3%. By controlling the increase rate of the occupancy of the second crossover points after ten times washing within the above range, it is possible to keep the air permeability of the woven fabric within an appropriate range even after repetitive washing.

Figure 4:
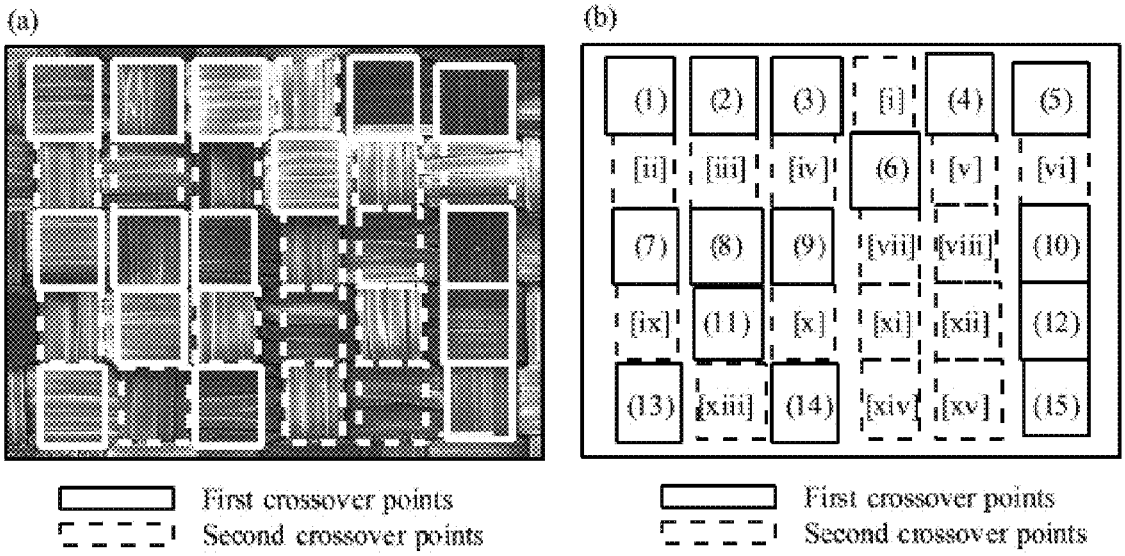
FIG. 4 shows diagrams illustrating how to find the percentage of first crossover points.

It is desirable that the first crossover points are not uniformly dispersed in the woven fabric, but rather are present as a group in which 2 to 10, more preferably 2 to 4, first crossover points are adjacent to each other. FIG. 4(*a*) shows an example of the woven fabric of the present invention. At 30 crossover points in a structure comprising five warp threads and six weft threads, as shown in FIG. 4(*a*), 15 first crossover points and 15 second crossover points are present. In FIG. 4 (*a*), it can be seen that the first crossover points are not present alternately with the second crossover points but the first crossover points are present as a group (for example, arrangements (1) to (3), arrangements (4) to (5), arrangements (7) to (9), arrangements (10)/(12)/(15)). When the first crossover points can be present as a group, it is possible to effectively inhibit the coming out of the fillings.

It is also preferable that the second crossover points are present as a group in which 2 to 10, more preferably 2 to 6, second crossover points are adjacent to each other, and when the second crossover points can be present as a group, it might be easy to obtain a woven fabric having a high degree of air permeability.

In the present invention, a weave structure is not necessarily limited to a plain structure, and it is also possible to employ a rip stop taffeta structure or the like which will be described later. Since in the portion where floating threads are present in the rip portion, the filaments tend to be arranged in two layers or two or more layers, such a portion contributes to a low air permeability. Thus, it is to be noted that the rip portion is counted as a first crossover point in the present invention. As the thread of the rip portion, a paralleled thread of two or more threads used in a plain structure, or one thread having a fineness of about 1.8 to 4.2 times larger than one thread used in a plain structure, can be employed. However, when counting the rip portion as the first crossover point, even if the rip portion is formed by paralleling a plurality of threads, the rip portion is counted as one thread (warp thread or weft thread).

<II. Substantially Quadrilateral Shaped Filament/Synthetic Fiber Multi-Filament>

The woven fabric of the present invention comprises warp threads constituted by substantially quadrilateral shaped filaments and weft threads constituted by substantially quadrilateral shaped filaments. By making the cross section of the filament into a substantially quadrilateral shape, it is possible to increase the contact area between adjacent filaments and to suppress rolling of the filaments due to external stimuli such as washing and the like.

II-1. Substantially Quadrilateral Shaped Filament

The substantially quadrilateral shaped filament means a filament having a substantially quadrilateral shaped cross section. Here, the "substantially quadrilateral shape" means a planar figure having four sides. Ideally, it is desirable that in a substantially quadrilateral shape (including parallelogram, diamond, rectangle, which will be described later), the four apexes are clear and the four sides are straight lines. However, in the process of producing a substantially quadrilateral shaped filament, there are cases where the apexes are not necessarily clear and a part of the sides would be curved due to unevenness of the resin extrusion speed, discharge rate, cooling rate, etc. Nevertheless, it should be noted that such a substantially quadrilateral shape including the production problem (that is, a substantially quadrilateral shape having unclear apexes or a substantially quadrilateral shape where a part of the sides is a curve) is also included in the substantially quadrilateral shape of the present invention.

As the substantially quadrilateral shape, for example, a parallelogram in which two pairs of opposite sides are parallel is preferable. When two pairs of opposite sides are parallel to each other, the substantially quadrilateral shaped filaments that are adjacent to each other tend to come into contact with each other, and such filaments also tend to be aligned in a line. In addition, even when the filaments are arranged in two or more lines, it is possible to suppress the displacement of the substantially quadrilateral shaped filaments from each other at a high level. In the parallelogram, there are features such that two pairs of opposite angles are equal in magnitude to each other, and two pairs of opposite sides are equal in length to each other. Therefore, the parallelogram in the present invention includes a diamond with four sides all having the same length, a rectangle with four interior angles being all equal in magnitude, and a square with four sides all having the same length and four interior angles being all equal in magnitude.

A pair of opposite angles in the parallelogram are preferably not less than 30 degrees, more preferably not less than 35 degrees, and even more preferably not less than 40 degrees. If a pair of opposite angles fall below 30 degrees, the substantially quadrilateral shaped filament would be linear, and the adjacent substantially quadrilateral shaped filaments are difficult to come into contact with each other, making it difficult to maintain the low air permeability of the woven fabric, which is not desirable. Also, a pair of opposite angles in the parallelogram are preferably not more than 90 degrees, more preferably not more than 85 degrees, and even more preferably not more than 80 degrees. In a parallelogram with a pair of opposite angles of around 90 degrees (for example, a square or a rectangle), when arranging the substantially quadrilateral shaped filaments, such filaments are rarely rotated around a central axis in the longitudinal direction. Such a rotation may result in the sides of the adjacent substantially quadrilateral shaped filaments not overlapping neatly with each other. When the opposite angles are set to not more than 85 degrees, the sides of the adjacent substantially quadrilateral shaped filaments are neatly overlapped with each other, so that the filaments tend to be evenly aligned in a line.

Particularly, the parallelogram is more preferably a diamond having four sides all having the same length. For example, in the case of a parallelogram or a rectangle in which the lengths of two pairs of sides are greatly different, an arrangement of filaments is likely to be disturbed in the case where the sides each having different length of the substantially quadrilateral shaped filaments are brought into contact with each other, and portions in which the substantially quadrilateral shaped filaments are not aligned in a line neatly are likely to be formed. However, by unifying the lengths of all four sides, it might be easy to align the substantially quadrilateral shaped filaments in a line.

The length of one side of the substantially quadrilateral shape is preferably not less than 7 μm, more preferably not less than 9 μm, even more preferably not less than 12 μm, and particularly preferably not less than 15 μm, and is preferably not more than 40 μm, more preferably not more than 35 μm, even more preferably not more than 30 μm, and particularly preferably not more than 25 μm. If the length of the side is too short, the substantially quadrilateral shaped filament also tends to be thin, and troubles such as easy breakage of threads may occur. If the side is too long, it is difficult for the substantially quadrilateral shaped filaments to be aligned in a line, and thus the fabric may be thick.

Further, in the substantially quadrilateral shape, the ratio of the short side to the long side (short side/long side) is preferably from 0.30 to 1.0, more preferably from 0.40 to 1.0, and even more preferably from 0.55 to 1.0.

It is preferable that the substantially quadrilateral shaped filament is relatively thick so that reduction in air permeability and woven fabric strength due to breakage of the substantially quadrilateral shaped filament by rubbing or scratching during use does not occur. In addition, by making the substantially quadrilateral shaped filaments relatively thick, such filaments included in the front threads tend to be brought into contact with each other at the surface, so that rolling of the filaments is suppressed even after repeated washing. Thus, deterioration of the air permeability caused by rolling of the filaments can be suppressed. In addition, since the filament has a large fineness, it would be difficult for the fiber to be pulled out by rubbing or scratching, resulting in improvement of snag performance. From such a viewpoint, the single yarn fineness of the substantially quadrilateral shaped filament is preferably not less than 1.0 dtex, more preferably not less than 1.5 dtex, even more preferably not less than 2.0 dtex, and still even more preferably not less than 2.5 dtex. On the other hand, if the substantially quadrilateral shaped filament is too large, the woven fabric would be hard and it would be difficult to produce a fabric with high density. Thus, the single yarn fineness of the substantially quadrilateral shaped filament is usually not more than 7.0 dtex, preferably not more than 6.0 dtex, and more preferably not more than 5.5 dtex.

The substantially quadrilateral shaped filament is desirably a synthetic fiber made of a resin. The resin is not particularly limited, but examples thereof include polyesters such as polyethylene terephthalate and polybutylene terephthalate; polyamides such as nylon 6, nylon 66, nylon 46, nylon 12, nylon 610, and nylon 612 and a copolymer thereof; and synthetic polymers such as polyacrylonitrile, polyvinyl chloride, and polyvinyl alcohol, and these may be used in combination.

The synthetic fiber multi-filament is preferably formed mainly from polyesters (more preferably polyethylene terephthalate) or polyamides (more preferably nylon). Particularly, polyamides are preferable because they can soften the texture of a woven fabric and can also increase the tear strength of a woven fabric. The percentage of filaments made of polyesters is preferably not less than 80% by mass, more preferably not less than 90% by mass, and even more preferably 100% by mass, with respect to 100% by mass of all the filaments constituting the synthetic fiber multi-filament. The percentage of filaments made of polyamides is preferably not less than 80% by mass, more preferably not less than 90% by mass, and further preferably 100% by mass, with respect to 100% by mass of all the filaments constituting the synthetic fiber multi-filament.

When polyesters are used as a raw material for the substantially quadrilateral shaped filament, the intrinsic viscosity of the polyester resin is preferably not less than 0.40, more preferably not less than 0.45, and even more preferably not less than 0.48, but the upper limit is not particularly limited and the intrinsic viscosity of the polyester resin is usually not more than 1.5. When the intrinsic viscosity of the polyester resin is not less than 0.40, this intrinsic viscosity is preferable because the substantially quadrilateral shaped filament having such an intrinsic viscosity has an appropriate breaking strength. On the other hand, if the intrinsic viscosity of the resin is less than 0.40, a modified cross section has a weak breaking strength as compared with a round cross section, and thus the following problems may occur: reduction in the tear strength and breaking strength of a product for lack of breaking strength, and deterioration in processing operability and product durability for lack of breaking elongation.

When polyamides are used as a raw material for the substantially quadrilateral shaped filament, the relative viscosity of the polyamide resin (preferably nylon) is preferably not less than 2.0, more preferably not less than 2.5, and even more preferably not less than 3.0, but the upper limit is not particularly limited and the relative viscosity of the polyamide resin is usually not more than 4.5. When the relative viscosity of the polyamide resin is not less than 2.0, this relative viscosity is preferable because the substantially quadrilateral shaped filament has an appropriate breaking strength. Particularly, when the relative viscosity of the polyamide resin is not less than 2.5, the substantially quadrilateral shaped filament can have an appropriate breaking elongation in addition to the breaking strength. Furthermore, when the relative viscosity is not less than 3.0, it is possible to clearly form four angles of a substantially quadrilateral cross section. On the other hand, if the relative viscosity of the polyamide resin is less than 2.0, a modified cross section has a weak breaking strength as compared with a round cross section, and thus the following problems may occur: reduction in the tear strength and breaking strength of a product for lack of breaking strength, and deterioration in processing operability and product durability for lack of breaking elongation. If the relative viscosity is higher than 4.5, the aimed modified cross section degree would be higher, but the strength of the thread would be too high, and when the thread is made into a cloth, it would be a fabric which has a texture which is too hard, resulting in a problem of poor usability though the fabric is thin.

A hygroscopic substance, an antioxidant, a matting agent, an ultraviolet absorber, an antimicrobial agent, and the like may be added to the substantially quadrilateral shaped filament singly or in combination, as needed. The boiling water shrinkage, thermal stress, birefringence index, thickness unevenness, and the like of the modified cross section filament are not particularly limited and they may be appropriately set.

II-2. Synthetic Fiber Multi-Filament

The synthetic fiber multi-filament includes two or more of the substantially quadrilateral shaped filaments having a substantially quadrilateral shaped cross section. The number of the substantially quadrilateral shaped filaments included in one synthetic fiber multi-filament is preferably not less than 3, more preferably not less than 4, and even more preferably not less than 5, and is preferably not more than 20, more preferably not more than 12, and even more preferably not more than 9. By setting the number of the substantially quadrilateral shaped filaments to the above range, the presence ratio of the first crossover points can be adjusted within the above range. Under the condition that the total fineness of the synthetic fiber multi-filament is made constant, if the number of the substantially quadrilateral shaped filaments is excessively increased, the single yarn fineness of the substantially quadrilateral shaped filaments would be relatively small, resulting in occurrence of troubles such as easy breakage of threads, which is not desirable.

The total fineness of the synthetic fiber multi-filament is preferably not less than 5.0 dtex, more preferably not less than 10 dtex, and even more preferably not less than 13 dtex, and is usually not more than 40 dtex, more preferably not more than 35 dtex, and even more preferably not more than 30 dtex. By adjusting the total fineness of the synthetic fiber multi-filament to the above range, a lightweight thin woven fabric having a necessary strength can be obtained. On the other hand, if the total fineness of the synthetic fiber multi-filament is less than the lower limit, the necessary strength may not be obtained in some cases, and if the fineness exceeds the upper limit, a bulky fabric is produced, making it difficult to obtain a lightweight thin woven fabric.

Although the breaking strength of the synthetic fiber multi-filament is not particularly limited, it is preferably from 3.0 cN/dtex to 10 cN/dtex, and more preferably from 3.5 cN/dtex to 10 cN/dtex. When the strength of the synthetic fiber multi-filament is not less than 3.0 cN/dtex, a woven fabric having a suitable tear strength can be obtained even if a filament with a high degree of modified cross section such as a substantially quadrilateral shaped filament is used. Also, when the strength of the synthetic fiber multi— filament is not more than 10 cN/dtex, a fabric with a soft texture for clothing is easily obtained.

Although the breaking elongation of the synthetic fiber multi-filament is not particularly limited, it is preferably from 25% to 55%, more preferably from 30% to 50%, and even more preferably from 40% to 45%. Within the above range, it is possible to stably weave using the substantially quadrilateral shaped filaments having highly modified cross section.

The synthetic fiber multi-filament may be any one of raw yarn, false twisted yarn, twisted yarn, and air-interlaced yarn. Raw yarn which is not subjected to specific processing is preferable from the advantages such that the first crossover points are easily constituted in a woven fabric and the filament would be difficult to roll even after washing. When applying air-interlaced yarn to raw yarn, it is better to set the degree of entanglement to 1 to 35 in accordance with JIS L 1013 8.15 (2010; hook method).

<III. Other Characteristics of Woven Fabric>

Hereinafter, the characteristics of the woven fabric of the present invention will be specifically described. For obtaining a woven fabric resistant to rubbing or scratching while ensuring a high air permeability, the percentage of the synthetic fiber multi-filament including substantially quadrilateral shaped filaments is preferably not less than 40% by mass, more preferably not less than 55% by mass, even more preferably not less than 65% by mass, particularly preferably not less than 80% by mass, and furthermore preferably not less than 90% by mass. The upper limit of the percentage of such multi-filaments is not particularly limited, but such percentage is preferably 100% by mass or may be not more than 95% by mass. By setting the percentage of the synthetic fiber multi-filament including substantially quadrilateral shaped filaments to not less than 40% by mass, it is possible to provide a woven fabric that is resistant to external stimuli such as rubbing and washing and ensures a stable air permeability even though the woven fabric has a high air permeability. Furthermore, resistance to seam slippage as well as to abrasion is easily obtained in the woven fabric.

The cover factor (CF) of the woven fabric of the present invention is preferably not less than 1450, more preferably not less than 1500, even more preferably not less than 1550, and particularly preferably not less than 1600. The upper limit of the cover factor is not particularly limited, but it is preferably not more than 2400, more preferably not more than 2200, and even more preferably not more than 1890. By adjusting the cover factor of the woven fabric to the above-mentioned range, a soft lightweight thin fabric having a high air permeability can be obtained. On the other hand, if the cover factor of the woven fabric falls below the above range, a lightweight thin fabric can be obtained, but the air permeability might be too high even if the woven fabric is subjected to calendering a plurality of times. If the cover factor exceeds the upper limit, only a woven fabric having a low air permeability and a heavy weight at the same time can be obtained, which is not preferable. Here, the cover factor (CF) of the woven fabric is calculated by the following formula:

$$CF=T\times(DT)^{1/2}+W\times(DW)^{1/2}$$

wherein T and W denote the warp density and the weft density (threads/2.54 cm) of the woven fabric, respectively, and DT and DW denote the fineness (dtex) of the warp constituting the woven fabric and the fineness (dtex) of the weft constituting the woven fabric, respectively.

The weight of the woven fabric of the present invention is preferably not less than 15 g/m$^2$, more preferably not less than 20 g/m$^2$, and even more preferably not less than 25 g/m$^2$, and is preferably not more than 80 g/m$^2$, more preferably not more than 70 g/m$^2$, and even more preferably not more than 60 g/m$^2$. By adjusting the weight of the woven fabric to the above range, a woven fabric having a high air permeability even though it is thin can be obtained. On the other hand, if the weight of the woven fabric is less than 15 g/m$^2$, a thin lightweight fabric will be completed, but a woven fabric having strong tear strength cannot be obtained, and if the weight of the woven fabric exceeds 80 g/m$^2$, a thick fabric is formed, resulting in failure to obtain a lightweight woven fabric.

The finishing density of the woven fabric is preferably not less than 130 threads/2.54 cm, more preferably not less than 155 threads/2.54 cm, and even more preferably not less than 170 threads/2.54 cm, and is preferably not more than 350 threads/2.54 cm, more preferably not more than 250 threads/2.54 cm, and even more preferably not more than 220 threads/2.54 cm, in each of the warp direction and the weft direction. By adjusting the finishing density of the woven fabric to the above range, it could be possible to control the presence ratio of the first crossover points within an appropriate range.

For forming the first crossover points at a certain ratio, it is desirable that the width per single synthetic fiber multi-filament calculated from the finishing density is slightly larger than the length obtained by closely aligning the filaments contained in the synthetic fiber multi-filament in a line. That is, it is desirable that at least one of $K_T$ and $K_W$, more preferably both of $K_T$ and $K_W$, determined by the following formulas (i) to (ii), meet not more than 140%, more preferably not more than 120%. When $K_T$ and $K_W$ are each less than 100%, the second crossover points are likely to be formed, so that the lower limit of each of $K_T$ and $K_W$ is not less than 50% (more preferably not less than 90%).

$$K_T=\{1/T\}/\{L\}\times 100 \quad \text{(i)}$$

$$K_W=\{1/W\}/\{L\}\times 100 \quad \text{(ii)}$$

In the formulas, L is a length (cm) of filaments that are contained in a single synthetic fiber multi-filament and are closely aligned in a line. T and W denote a finishing warp density (threads/2.54 cm) of the woven fabric and a finishing weft density (threads/2.54 cm) of the woven fabric, respectively.

The tear strength, as measured by the pendulum method, of the woven fabric of the present invention is not particularly limited, but is preferably from 5 N to 50 N, more preferably from 6 N to 40 N, and even more preferably from 7 N to 30 N in the warp direction and the weft direction, respectively. By adjusting the tear strength of the woven fabric to the above range, a woven fabric having a thin lightweight texture and a necessary tear strength is obtained.

The woven fabric shows an initial air permeability (based on the air permeability A method (Frazier type method) prescribed in JIS L 1096 8.27.1) of not less than 2.0 cc/m$^2$/s, more preferably not less than 3.0 cc/cm$^2$/s, and even more preferably not less than 3.5 cc/cm$^2$/s, and is preferably not more than 25 cc/cm$^2$/s, more preferably not more than 20 cc/cm$^2$/s, and even more preferably not more than 15 cc/cm$^2$/s. When the initial air permeability is within the above range, a woven fabric which is excellent in eliminating stuffy feeling (discomfort due to moisture) can be obtained.

Since the woven fabric of the present invention is a fabric in which the filament is difficult to move even by external force of washing, the woven fabric shows an air permeability after ten times washing (based on the method described in JIS L 0217 103 (1995; washing at 40° C. using a Japanese style washing machine (pulsator type))) of not more than 30 cc/cm$^2$/s, preferably not more than 20 cc/cm$^2$/s, more preferably not more than 10 cc/cm$^2$/s or less, and although the lower limit is not limited, an air permeability of not less than 2.0 cc/cm$^2$/s is preferred.

Since the contact area between the adjacent substantially quadrilateral shaped filaments is large in the woven fabric of the present invention, the fibers arranged in a line are closely fixed to each other. Furthermore, since the substantially quadrilateral shaped filaments are strongly kept in a state where such filaments are arranged in two or more lines, the woven fabric shows a rate of change of the air permeability after ten times washing with respect to the initial air permeability before washing of not more than 1.8, more preferably not more than 1.6, and even more preferably not more than 1.5. The lower limit of the rate of change of the air permeability after ten times washing is not particularly limited, but it is preferably not less than 0.8, and usually not less than 1.0. When the rate of change after washing is less than this value, a woven fabric having both functions of preventing deterioration of aeration and suppressing stuffy feeling due to perspiration is obtained while maintaining a certain heat-retaining property.

The woven fabric of the present invention can have a slipping resistance value of preferably not more than 4.0 mm, more preferably not more than 3.0 mm, and particularly preferably not more than 2.5 mm, in the warp direction and the weft direction, respectively, under a load of 12 kg in accordance with JIS L 1096 8.23.1 B method (2010).

Further, the woven fabric of the present invention can have a slipping resistance value of preferably not more than 10 mm, more preferably not more than 5.0 mm, and particularly preferably not more than 3.0 mm, in the warp direction and the weft direction, respectively, under a load of 12 kg in accordance with JIS L 1096 8.23.1 B method (2010) after ten times washing.

Further, the woven fabric of the present invention can have a value, which is calculated by dividing the air permeability after ten times washing by the slipping resistance value after ten times washing, of preferably not more than 15 cc/cm$^2$/s/mm, more preferably not more than 10 cc/cm$^2$/s/mm, even more preferably not more than 5.0 cc/cm$^2$/s/mm, preferably not less than 1.2 cc/cm$^2$/s/mm, more preferably not less than 1.3 cc/cm$^2$/s/mm, even more preferably not less than 1.5 cc/cm$^2$/s/mm in the warp direction and the weft direction, respectively. By controlling the value calculated by dividing the air permeability after ten times washing by the slipping resistance value after ten times washing within the above range, it is possible to keep the air permeability of the woven fabric within an appropriate range even after repetitive washing.

In the woven fabric of the present invention, even after 200 times abrasion, pulling of not less than 4 cm, fluffing of not less than 2 mm, and hole formation of not less than 1 mm are not observed and the occurrence of filament separation on the surface of the fabric due to abrasion is small. Thus, the abrasion level after 200 times abrasion, which is evaluated by the method described in the section of the Example, can achieve the level 2 or higher, more preferably level 3. In the most preferred aspect of the woven fabric of the present invention, it is possible to obtain a woven fabric in which pulling, fluffing, and hole formation are not observed. As a result, the woven fabric of the present invention is a woven fabric excellent in durability of performances in a consumption stage.

<IV. Production Method of Woven Fabric>

IV-1. Production Method of Substantially quadrilateral Shaped Filament

Figure 9:
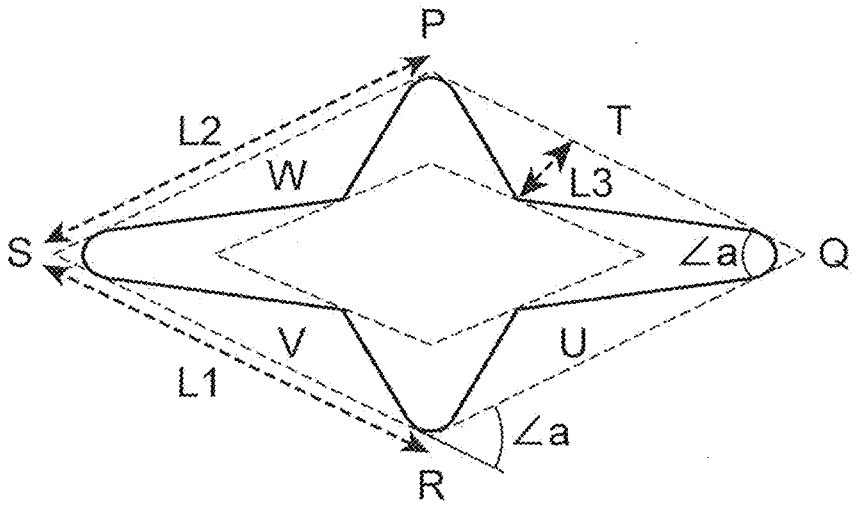
FIG. 9 is a cross-sectional view schematically showing a discharge opening in a mold used for spinning a filament in the form of a diamond.

It is desirable to spin a resin from a spinneret discharge opening having four convex portions (apexes) so as to produce a substantially quadrilateral shaped filament used in the present invention. Specifically, it is preferable to design the shape of the spinneret discharge opening of the nozzle to a star shape as shown in FIG. 9. That is, a star-shaped spinneret discharge opening capable of forming a substantially quadrilateral shaped filament has four convex portions (for example, P to S in FIG. 9) and four concave portions (for example, T to W in FIG. 9), and it is desirable that two pairs of opposite angles of the convex portions are the same with each other and the diagonal lines of the convex portion are orthogonal. When a raw material resin is spun through such a star-shaped spinneret discharge opening, the molten resin expands to spread in the four convex portions, and results in producing a filament having a substantially quadrilateral shaped fiber cross section by connecting the four convex portions. Therefore, by adjusting the angle formed by connecting the three convex portions of the discharge opening, it is possible to design an interior angle of the substantially quadrilateral shape (that is, the interior angle of Q in the substantially quadrilateral shape is substantially equal to the angle formed by connecting the three apexes P, Q, and R of the convex portion.).

In this star-shaped spinneret discharge opening, it is preferable that each tip of the four convex portions is rounded, not being formed at an acute angle. By rounding the tip, it would be easier to form clear apexes without distortion of apexes of the substantially quadrilateral shape.

Furthermore, as the conditions for making a substantially quadrilateral shape into a parallelogram, it is preferable to make the depth (L3 in FIG. 9) all equal in the four concave portions. The depth of the concave portion is preferably from 0.02 mm to 0.14 mm, and more preferably from 0.04 mm to 0.12 mm. If such a depth is less than 0.02 mm, the polymer expands outward and a well-balanced parallelogram cannot be formed in some cases at the time of spinning of the filaments. If the depth is greater than 0.14 mm, the cross section of the fiber might be a star shape due to insufficient expansion even if the spun polymer expands.

Further, when cooling the spun polymer, it is preferable to set the position of the nozzle opening so that cooling air blows on each convex portion of P, Q, R, and S in FIG. 9. In this process, it is preferable to set the positions of the nozzle opening so that cooling air does not directly blow on the concave portions of T, U, V, and W in FIG. 9. By providing a portion where cooling air is actively applied to the unevenness and a portion where cooling air is not applied to the unevenness, it is easy to form a uniform parallelogram. Particularly, as the conditions for making a substantially quadrilateral shape into a diamond shape, it is necessary to further equalize the lengths of four sides while satisfying the above-mentioned conditions. Thus, regarding the viscosity of the polymer, the intrinsic viscosity is preferably not less than 0.5 in the case of polyester, and the relative viscosity is preferably not less than 2.5 in the case of polyamide. By adjusting the viscosity, it is easy to form a diamond cross section having all four sides being equal in length.

A method for producing a synthetic fiber multi-filament including substantially quadrilateral shaped filaments is not particularly limited, but a polyamide type synthetic fiber multi-filament or a polyester type synthetic fiber multi-filament can be produced by using a spin-draw continuous machine in a spin-draw mode, or by using a spinning machine and a drawing machine in two stages. In the spin draw mode, the rotary speed of the spin yarn pulling godet roller is set to the range preferably from 1500 m/min to 4000 m/min, and more preferably 2000 m/min to 3000 m/min.

IV-2 Production Method of Woven Fabric Weaving Step

First, a gray fabric is woven using a synthetic fiber multi-filament containing two or more substantially quadrilateral shaped filaments as a warp thread and a weft thread. The synthetic fiber multi-filament used in the weaving step is as described above.

The warp density is preferably not less than 50 threads/2.54 cm, not less than 80 threads/2.54 cm, and even more preferably not less than 100 threads/2.54 cm, and is preferably not more than 400 threads/2.54 cm, more preferably not more than 350 threads/2.54 cm, and even more preferably not more than 250 threads/2.54 cm. By adjusting the warp density within the above range, it is easy for the substantially quadrilateral shaped filaments to be aligned in a line and/or in two lines, which is preferable.

For the same reasons, the weft density is preferably not less than 50 threads/2.54 cm, more preferably not less than 80 threads/2.54 cm, and even more preferably not less than 100 threads/2.54 cm, and is preferably not more than 400 threads/2.54 cm, more preferably not more than 350 threads/2.54 cm, and even more preferably not more than 250 threads/2.54 cm. The gray woven fabric density may be equal to or different from the finishing density.

Figure 7:
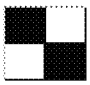
FIG. 7 is a diagram schematically illustrating an example of a woven structure of taffeta.
Figures 1, 8:
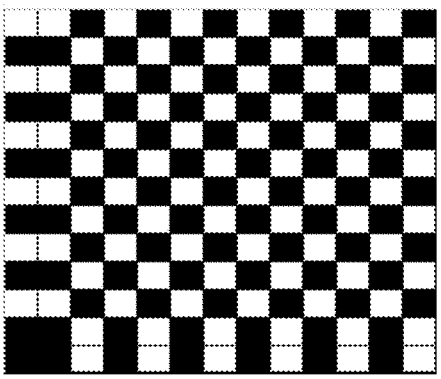
Figures 2, 8:
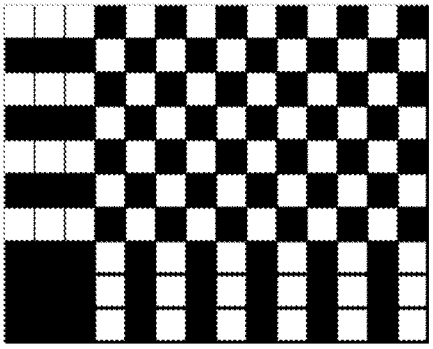
Figures 3, 8:
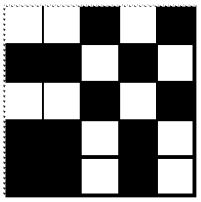
Figures 4, 8:
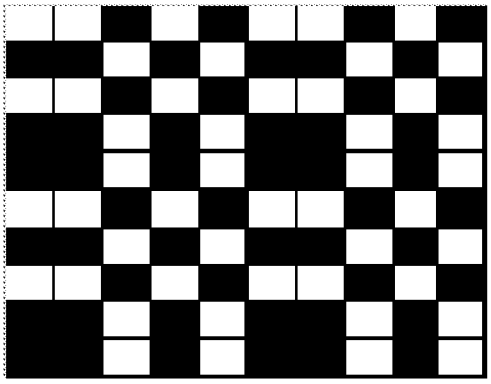

Also, the weave structure is not particularly limited, and any weave structure such as plain weave (see FIG. 7), twill weave, or satin weave may be employed. Among them, the plain weave is preferably used because of down-proof. Furthermore, for example, a rip stop taffeta having a complete structure illustrated in FIGS. 8-1 to 8-4 is preferably employed so that the tear strength of a thin woven fabric is increased.

A loom used in the weaving process is not particularly limited, and examples of the machine include a water jet loom, an air jet loom, and a rapier loom. Of these, a water jet loom or an air jet loom is preferred.

The synthetic fiber multi-filaments containing substantially quadrilateral shaped filaments (for example, diamond, square, parallelogram) are likely to be fluffed because the substantially quadrilateral shaped filament has a larger contact area with a heald than the filament having a round cross section. Therefore, the heald used in a loom is preferably a ceramic material for the sake of reducing the friction with the thread. As mentioned above, it might be possible to weave with low friction by using the ceramic material, thereby to suppress the occurrence of fluffing. In the weaving step, a low-tension sizing machine is preferably used.

b) Calendering Step

Next, as an arbitrary step, it is desirable to carry out calendering on at least one surface of the woven fabric obtained in the weaving step. In the calendering step, at least one surface of the woven fabric may be subjected to calendering. By subjecting the woven fabric to calendering, the substantially quadrilateral shaped filaments included in the woven fabric are compressed to eliminate the gaps between the filaments, thereby to bring the adjacent substantially quadrilateral shaped filaments easily into contact with each other on the surface. Thus, even when the woven fabric is washed, the filaments would be difficult to move due to the friction force between the filaments. In addition, softness can be imparted to the woven fabric by calendering. The calendering can be applied to one surface or both surfaces of the woven fabric. When a glossy surface is required for both sides of the woven fabric particularly from the viewpoint of designability, calendering may be applied to both surfaces of the woven fabric.

The frequency of calendering is not particularly limited, and calendering may be carried out only one time or two or more times. When calendering is applied, the pressure during calendering is preferably not less than 100 kg/cm, more preferably not less than 150 kg/cm, and even more preferably not less than 200 kg/cm, and is preferably not more than 300 kg/cm, more preferably not more than 280 kg/cm, and even more preferably not more than 250 kg/cm. By setting the pressure during calendering to the above range, the filaments can be easily arranged, which is preferable.

The temperature during calendering is preferably not lower than 50° C., more preferably not lower than 60° C., and even more preferably not lower than 70° C. The upper limit is desirably a temperature equivalent to or lower than the melting point of the material used for the woven fabric, and is preferably not higher than 200° C., more preferably not higher than 190° C., and even more preferably not higher than 180° C.

The speed during calendering is preferably not less than 5 m/min, more preferably not less than 10 m/min, and even more preferably not less than 15 m/min, and is preferably not more than 50 m/min, more preferably not more than 40 m/min, and even more preferably not more than 35 m/min. By setting the speed during calendering to the above range, the filaments can be easily paralleled, which is preferable.

The calendering conditions may be set in consideration of the ratio of the first crossover points to be formed and the production cost, and some examples of the calendering conditions are as follows; however, the present invention is not necessarily limited to these examples.

For example, in the case of producing a woven fabric having an initial air permeability of from 2.0 to 10 cc/cm$^2$/s, the following conditions are favorable: calendering frequency: once, calendering pressure: from 180 to 200 kg/cm, calendaring temperature: from 160 to 180° C., and calendering speed: from 30 to 50 m/min.

In the case of producing a woven fabric having an initial air permeability of from 10 to 20 cc/cm$^2$/s, the following conditions are favorable: calendering frequency: once, calendering pressure: from 150 to 180 kg/cm, calendaring temperature: from 70 to 100° C., and calendaring speed: from 15 to 20 m/min.

In the case of producing a woven fabric having an initial air permeability of 20 to 25 cc/cm$^2$/s, calendering may not be performed.

The obtained woven fabric may be scoured, relaxed, preset dyed, and subjected to finish processing by using a general textile processing machine. Further, a wrinkle processing step of imparting a natural wrinkle feeling may be added.

If necessary, the woven fabric of the present invention may also be subjected to various functional processing for treating, or adjusting the feeling or strength of the woven fabric, including, but not limited to, water-repellent treatment, oil-repellent treatment, coating, and laminating; softening processing; resin processing; and silicone processing. Examples of a softener that may be used in the softening processing include amino-modified silicones, polyethylene-based softeners, polyester-based softeners, and paraffin-based softeners. Examples of a resin processing agent that may be used in the resin processing include various resins such as melamine resins, glyoxal resins, urethane-based resins, acrylic resins, and polyester-based resins.

The adjacent filaments contained in the synthetic fiber multi-filament are desirably not fixed to each other in order to maintain the softness of the woven fabric, and the number of filaments in which the adjacent filaments are fixed to each other is preferably not more than 30%, more preferably not more than 10%, of the total number of filaments constituting the woven fabric.

<V. Use>

While the woven fabric of the present invention, obtained in this way, is a high density woven fabric that is lightweight and thin as well as has a high air permeability, it has characteristics excellent in abrasion resistance which have not been achieved in the past. Therefore, the woven fabric of the present invention is preferably applied to a windbreaker as an outer fabric, or a down product (for example, a down jacket, a sleeping bag, a coverlet, etc.) as an outer fabric.

EXAMPLES

Hereinafter, the present invention will be more specifically described by way of Examples. It will be understood that Examples below are not intended to limit the present invention, and a suitable modification may be made within a range meeting the gist described above and below, all of which are included in the technical scope of the present invention.

<Intrinsic Viscosity>

The intrinsic viscosity (IV) is a value obtained by measuring intrinsic viscosity[η] at 30° C. using a mixed solvent composed of p-chlorophenol and tetrachloroethane (ratio of p-chlorophenol to tetrachloroethane=75/25), and converting the measured value into intrinsic viscosity (IV) of a mixed solvent composed of phenol and tetrachloroethane (ratio of phenol to tetrachloroethane=60/40) in accordance with the following formula:

$$IV=0.8325\times[\eta]+0.005$$

<Relative Viscosity>

A sample was dissolved in an extra pure reagent of concentrated sulfuric acid having a concentration of 96.3±0.1% by mass to give a polymer concentration of 10 mg/ml. In this way, a sample solution was prepared. An Ostwald viscometer giving a water dropping time of 6 to 7 seconds at a temperature of 20±0.05° C. was used to measure the dropping time $T_1$ (seconds) of 20 ml of the prepared sample solution and the dropping time $T_0$ (seconds) of 20 ml of the extra pure reagent of concentrated sulfuric acid having a concentration of 96.3±0.1% by mass, used for the dissolution of the sample, at a temperature of 20±0.05° C. The relative viscosity (RV) of the resin was calculated from the following formula:

$$RV=T_1/T_0$$

<Measurement of Substantially Quadrilateral Cross Section>

(1) Measurement of Side Length

Using a VH-Z450 type microscope and a VH-6300 type measuring instrument (manufactured by KEYENCE CORPORATION), the length of each side of a substantially quadrilateral shaped filament was measured while observing the cross section at a magnification of 1500 times. The average in length of three filaments was determined as a side length.

(2) Measurement of Interior Angle

Using a VH-Z450 type microscope and a VH-6300 type measuring instrument (manufactured by KEYENCE CORPORATION), the cross section of a substantially quadrilateral shaped filament was photographed at a magnification of 1500 times, and the acute angle and the obtuse angle were respectively measured with a commercially available protractor (manufactured by KOKUYO CO., LTD.). Then, the average in angle of three filaments was determined as an acute angle and an obtuse angle, respectively.

<Total Fineness of Synthetic Fiber Multi-Filaments>

The fineness of synthetic fiber multi-filaments (total fineness) was determined by preparing three cassettes of 100-m-long synthetic fiber multi-filaments, measuring the mass (g) of each of the cassettes, averaging the resultant masses, and then multiplying the average by 100.

<Single Yarn Fineness (Monofilament Fineness)>

The single yarn fineness was determined by dividing the total fineness of the synthetic fiber multi-filaments by the number of the filaments.

Single yarn fineness=Total fineness of synthetic fiber multi-filaments/Number of filaments <Finishing Cover Factor>

The finishing cover factor (CF) of the woven fabric was calculated by the following formula:

$$CF=T\times(DT)^{1/2}+W\times(DW)^{1/2}$$

wherein T and W indicate the finishing warp density (threads/2.54 cm) of the woven fabric and the finishing weft density (threads/2.54 cm) of the woven fabric, respectively, and DT and DW indicate the fineness (dtex) of the warps constituting the woven fabric and the fineness (dtex) of the wefts constituting the woven fabric, respectively.

<Occupancy of First Crossover Points and Second Crossover Points>

(1) Using a scanning electron microscope ("JSM-6610 type", manufactured by JEOL LTD.), a surface of a woven fabric was photographed from above the fabric at a magnification of 120 times. In order to make a weave structure including five warp threads and six weft threads fit into the photograph, the photographing position was adjusted to include five crossover points in the warp direction and six crossover points in the weft direction, i.e., a total of 30 crossover points in the photograph at the time of photographing. Also, when the rip portion of a rip stop taffeta structure is formed by paralleling a plurality of threads, the photographing position was adjusted so that one thread (warp or weft) could be regarded as being driven.

(2) Using the taken photographs, 30 crossover points were classified as "first crossover point" or "second crossover point" based on the following criteria. A reference example is shown in FIG. 4 (*a*).

"First crossover point": an arrangement where the number of filaments at least a part of the exposed surface of which is confirmed not to be obstructed by another filament at the crossover point is equal to the number of filaments that are actually included in the front threads.

"Second crossover point": an arrangement where the number of filaments at least a part of the exposed surface of which is confirmed not to be obstructed by another filament at the crossover point is less than the number of filaments that are actually included in the front threads.

(3) The occupancy of the first crossover points, and the occupancy of the second crossover points are calculated based on the following formulas:

Occupancy (%) of first crossover points=(Total number of first crossover points)/Number of crossover points (30 crossover points)×100

Occupancy (%) of second crossover points=(Total number of second crossover points)/Number of crossover points (30 crossover points)×100

For example, in the case of FIG. 4 (*a*), since the total number of the first crossover points is 15 from (1) to (15) and the total number of the second crossover points is 15 from (i) to (xv) as shown in FIG. 4 (*b*), the occupancy of the first crossover points is 50% (=15/30×100), and the occupancy of the second crossover points is 50% (=15/30×100).

(4) The above procedures (1) to (3) are carried out on arbitrary two places of the surface of the woven fabric and arbitrary two places of the back surface of the woven fabric. The occupancy of the first crossover points, and the occupancy of the second crossover points are respectively determined using the average from the four places in total.

5) The occupancy of the first crossover points, and the occupancy of the second crossover points were measured before and after washing described later. The increase rate of the occupancy of the second crossover points after ten times washing is calculated based on the following formula:

The increase rate of the occupancy of the second crossover points after ten times washing (%)={(the occupancy of the second crossover points after ten times washing)−(the occupancy of the second crossover points before washing)}/(the occupancy of the second crossover points before washing)*100.

<Air Permeability>

The initial air permeability ($L_0$) of the woven fabric was measured in accordance with the air permeability method A (Frazier type method) prescribed in JIS L 1096 8.27.1.

The air permeability ($L_{10}$) after ten times washing of the woven fabric was measured in accordance with JIS L 0217 103 method (1995; washing at 40° C. using a Japanese type washing machine (pulsator type)).

<Washing Method>

Washing of the woven fabric was carried out in accordance with the conditions prescribed in JIS L 1096 (Test method 103 for dimensional change of woven fabrics). "After ten times washing" is a measurement result after repeating washing-dehydration-drying ten times. Drying was performed by line drying. Even after ten times washing, the air permeability was measured by the method mentioned above.

<Slipping Resistance>

The slipping resistance was measured in accordance with JIS L 1096 8.23.1 B method (2010). The slipping resistance was measured before and after washing described before.

<The Air Permeability after Ten Times Washing/the Slipping Resistance Value after Ten Times Washing>

The value is calculated by dividing the air permeability after ten times washing by the slipping resistance value after ten times washing in the warp direction and the weft direction, respectively.

<Abrasion Level>

Figures 1, 10:
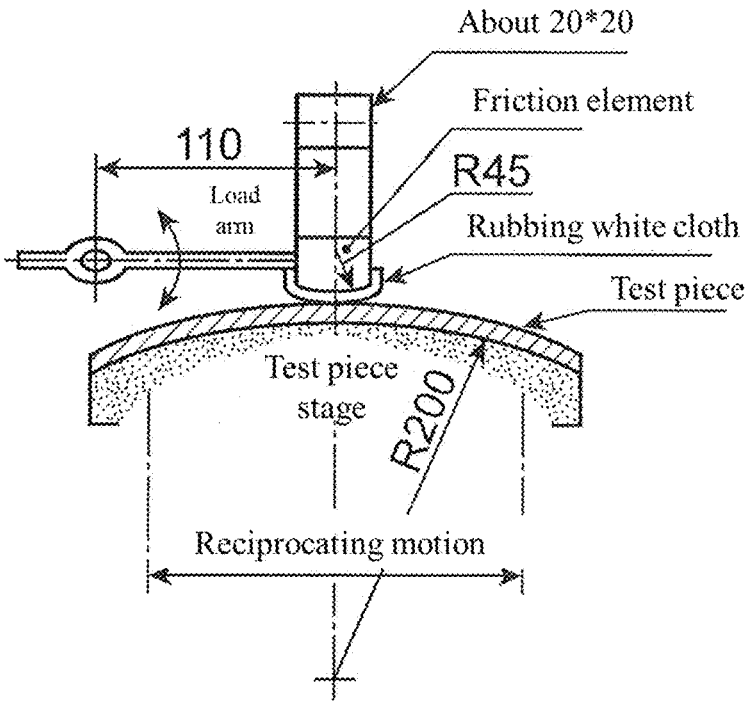
Figures 2, 10:
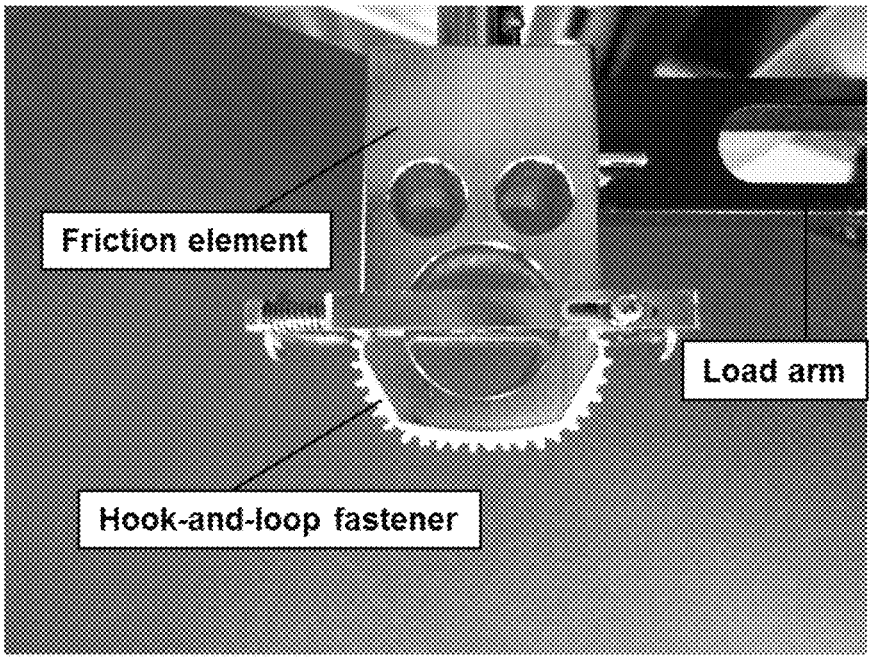
Figures 3, 10:
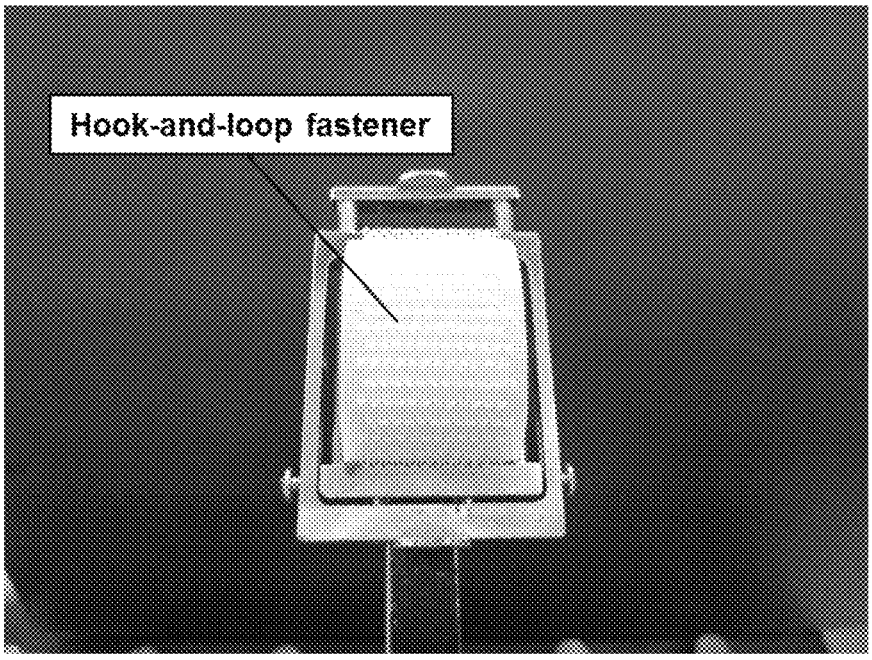
Figure 11:
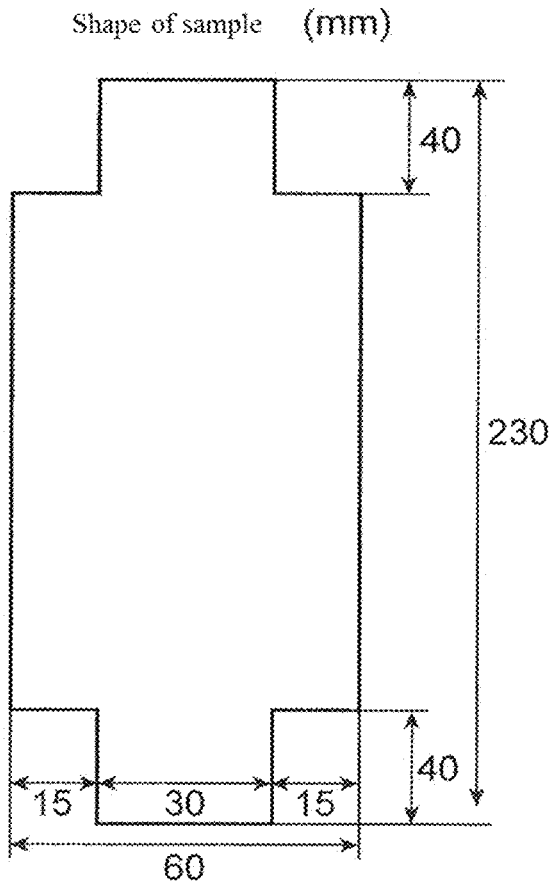
FIG. 11 is a diagram illustrating a test piece to be subjected to an abrasion resistance test.
Figure 12:
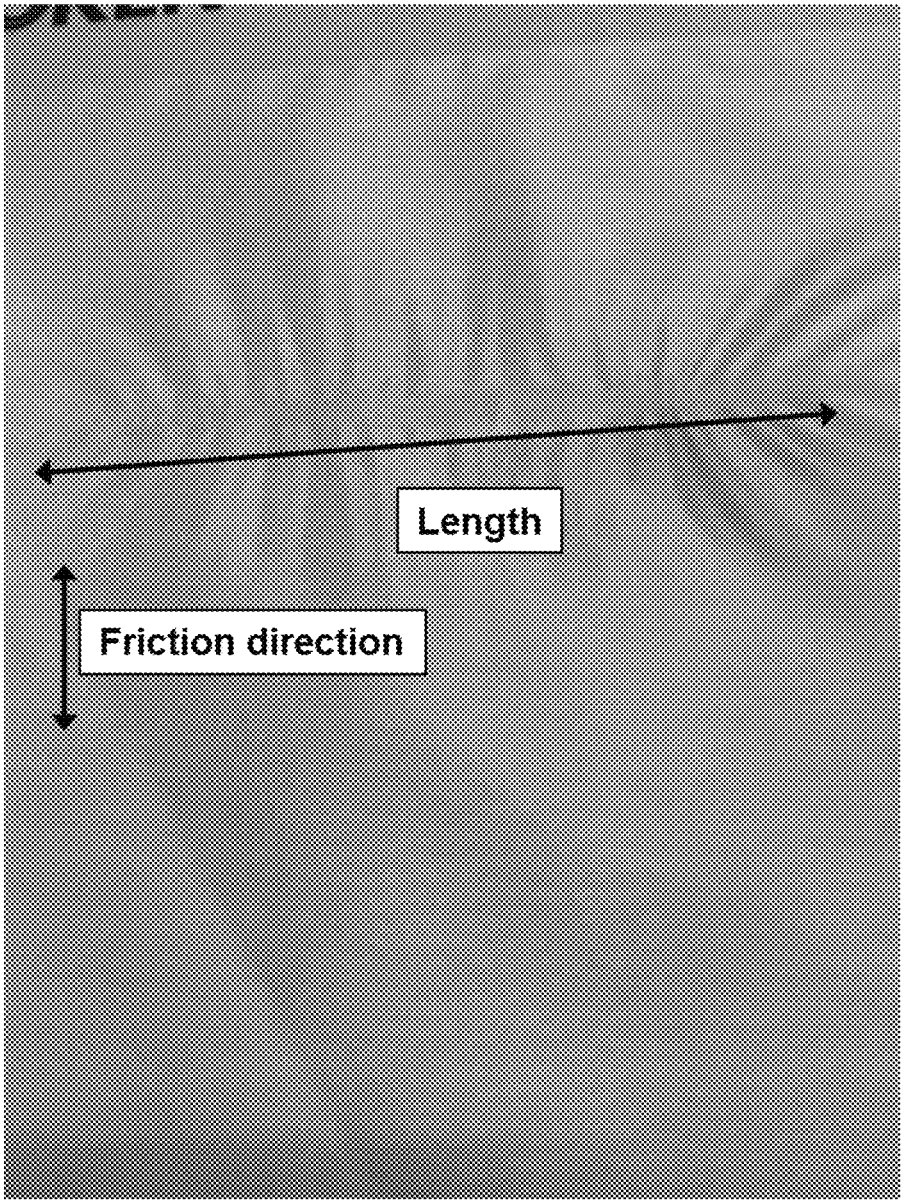
FIG. 12 is a photograph of a typical example of pulling.
Figure 13:
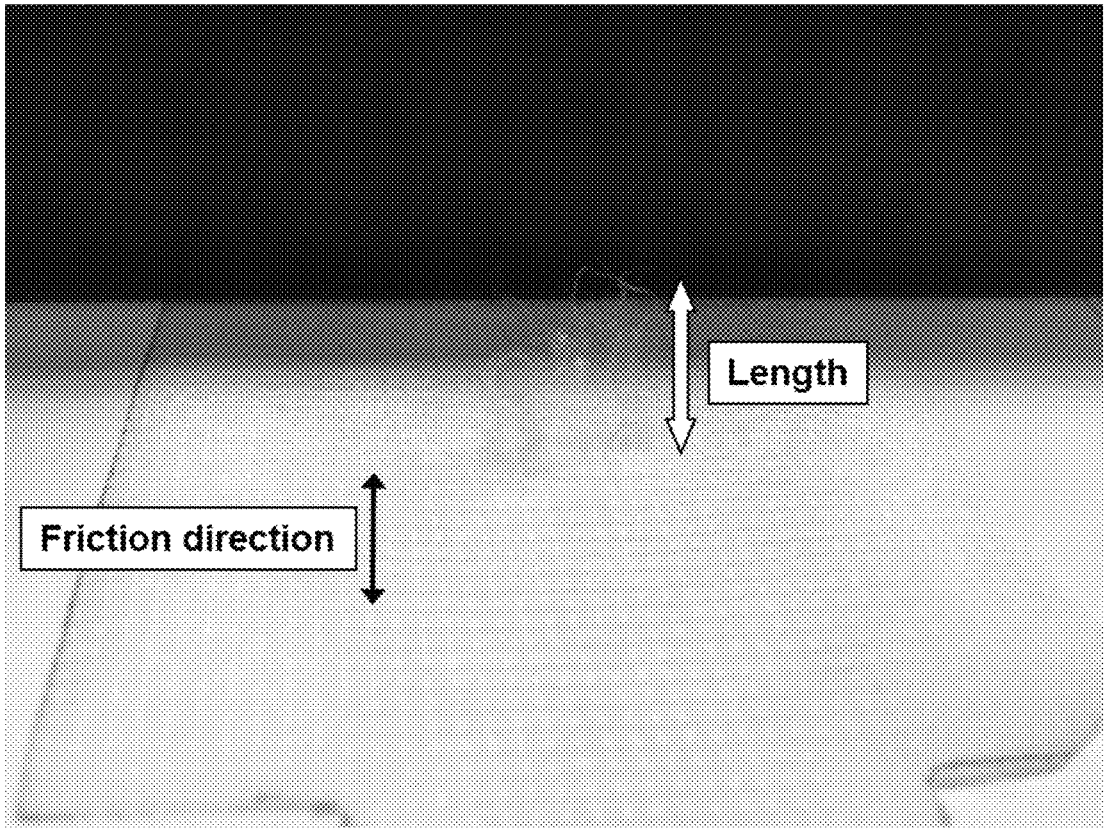
FIG. 13 is a photograph of a typical example of fluffing.
Figure 14:
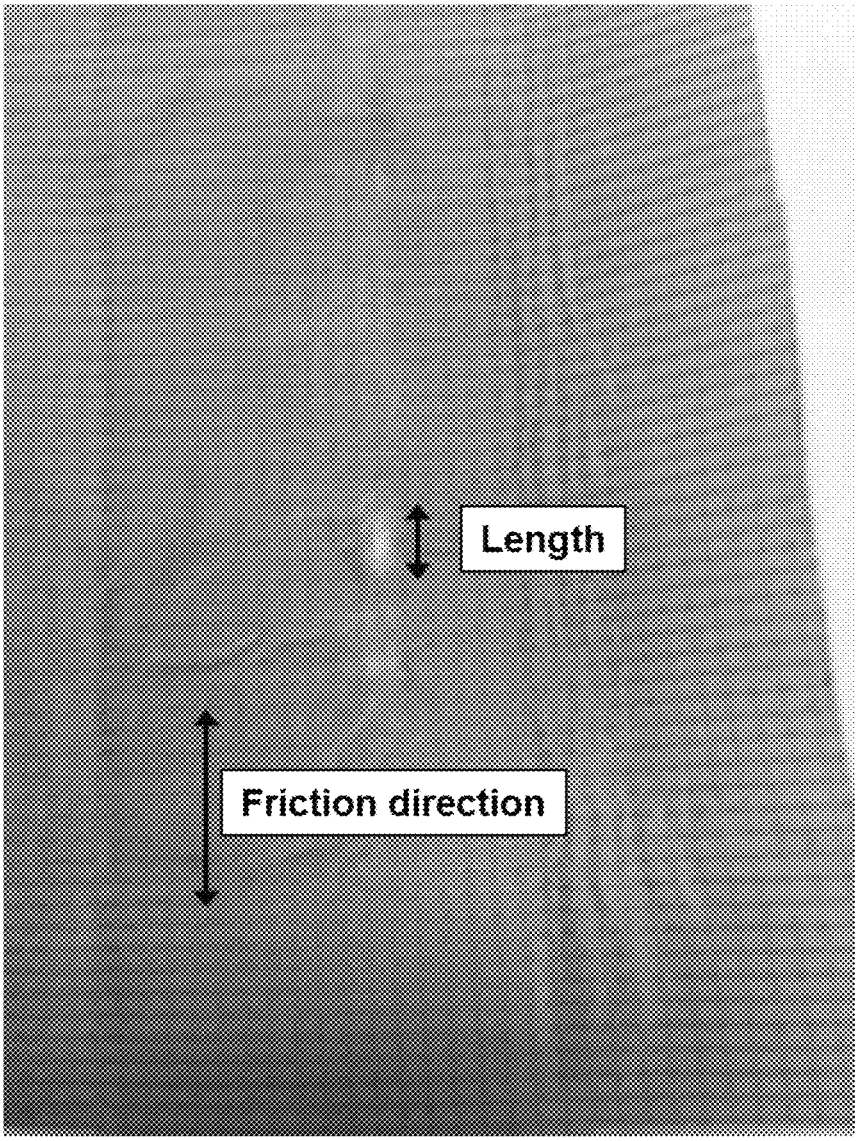
FIG. 14 is a photograph of a typical example of a hole.

1. Abrasion test: Using a color fastness rubbing tester II (JSPS-type) used in JIS L 0849, shown in FIGS. 10-1 to 10-3, a commercially available Velcro (registered trademark) #A0380 (male) manufactured by KURARAY CO., LTD is employed. A woven fabric is cut to a size of 60 mm in width and 230 mm in length, and set in a natural state on a double-sided tape (TERAOKA ANCHOR BRAND; width 25 mm) which has been pasted on a test piece stand. Both ends of the woven fabric are fixed with a sample fastener of the tester. The Velcro (registered trademark) described above is cut to a size of about 60 mm in length and about 20 mm in width, and fixed in the longitudinal direction along a friction element of the tester. A load of 300 g is added to the friction element of the tester to a total of 500 g. The test piece is cut into the shape as shown in FIG. 11, but when measuring the warp direction of the woven fabric, the warp thread of the woven fabric is cut to parallel to the longitudinal direction of FIG. 11 and set on the test piece stand. When measuring the weft direction of the woven fabric, the weft thread is made parallel to the longitudinal direction of FIG. 11. The measurement length is 10 cm, the friction speed is 30 reciprocations per minute, and the frequency of measurements is 200 reciprocations. The Velcro (registered trademark) is changed to a new one after every measurement (every 200 reciprocation).

2. Evaluation of Abrasion Level: Based on the table below, the state after the abrasion test was observed and evaluated for three phenomena of pulling, fluffing, and hole formation. The judgment on such phenomena was made for each of the warp direction and the weft direction once. The worse result of the evaluation results of warp/weft directions was employed as the evaluation result in "abrasion evaluation". That is, if at least one of the evaluation items has "remarkably noticeable", the abrasion level is judged as "unacceptable" (that is, even if the judgment results of fluffing and hole formation are "excellent", when the pulling is evaluated as "unacceptable", the abrasion level is judged as "unacceptable"). In evaluating each state, when a plurality of phenomena including pulling, fluffing, and hole formation occurred, the longest one was used for evaluating the abrasion level in each case. The judgment was performed in three levels of "excellent", "good" and "unacceptable", and "excellent" was digitized as level 3, "good" as level 2, and "unacceptable" as level 1.

TABLE 1

| State after abrasion | Item | Judgment criterion | Judgment |
|---|---|---|---|
| Pulling | None | Not observed visually | Excellent |
| | Observed | Less than 4 cm | Good |
| | Remarkably noticeable | Not less than 4 cm | Unacceptable |
| Fluffing | None | Not observed visually | Excellent |
| | Observed | Less than 2 mm | Good |
| | Remarkably noticeable | Not less than 2 mm | Unacceptable |
| Hole formation | None | Not observed visually | Excellent |
| | Observed | Less than 1 mm | Good |
| | Remarkably noticeable | Not less than 1 mm | Unacceptable |

Example 1

Figure 6:
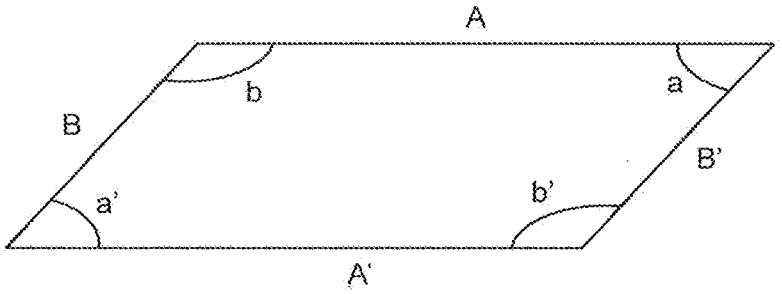
FIG. 6 is a diagram illustrating a cross section of a fiber of an odd-shaped monofilament for use in the present invention.

Nylon 6 polymer chips having a relative viscosity of 3.5 were melt-spun through a spinneret having 7 discharge openings (each having a structure shown in FIG. 9 in which L1 was 0.481 mm, L2 was 0.481 mm, L3 was 0.07 mm, and "angle a" was 54 degrees) at a spinning temperature of 282° C. First and second godet rollers were used, and the speed of the first godet roller was set to 2800 m/min, and the speed of the second godet roller was set to 4000 m/min. The polymer was drawn by the second godet roller at a drawing temperature of 160° C. There was obtained a synthetic fiber multifilament having a fineness of 22 dtex and including 7 filaments each having a diamond shaped cross section of a substantially quadrilateral shape in which the "angle a" was 54 degrees, the side A and the side A' were each 18.7 μm, and the side B and the side B' were each 18.7 μm, as shown in FIG. 6. A warp density was set to 171 threads/2.54 cm and a weft density was set to 189 threads/2.54 cm to weave a taffeta-weave fabric (a plain weave fabric) using the synthetic fiber multifilament as the warp and the weft.

In accordance with a conventional method, the thus obtained gray fabric was scoured using an open soaper, preset using a pin tenter at 190° C. for 30 seconds, dyed in gray with an acid dye using a j et dyeing machine ("Soft Circular CUT-NS" manufactured by HISAKA WORKS CO. LTD.), soft-finished, and subjected to intermediate setting at 180° C. for 30 seconds. Then, one surface of the woven fabric was subjected to calendering (calendering pressure: 180 kg/cm, calendering speed: 30 m/min, calendering temperature: 160° C.).

The warp density, weft density, rate of change of air permeability before and after washing, slipping resistance, and abrasion level of the obtained fabric were evaluated, respectively. The results are shown in Table 2.

Examples 2 to 10

In Example 2, a woven fabric was obtained in the same manner as in Example 1, except that the calendering was not applied to the obtained woven fabric.

In Example 3, a woven fabric was obtained in the same manner as in Example 1, except that the calendering conditions were changed.

In Example 4, a woven fabric was obtained in the same manner as in Example 2, except that the weaving density was changed.

In Examples 5 and 6, synthetic fiber multi-filaments shown in the table were produced by changing the discharge amount of the resin in the extruder, and woven fabrics were produced using the obtained synthetic fiber multi-filaments under the conditions shown in the table.

In Example 7, a woven fabric having a rip-stop taffeta structure shown in FIG. 8-1 was produced under the conditions shown in the table.

In Example 8, a woven fabric was obtained in the same manner as in Example 1, except that the "angle a" of the discharge opening was changed to 90 degrees and the sectional shape of the filament was changed to a square shape.

In Example 9, a woven fabric was obtained in the same manner as in Example 1, except that the substantially quadrilateral shaped cross section of the filament was changed to a parallelogram (sides A and A': 18.7 μm each, sides B and B': 28.0 μm each).

In Example 10, a woven fabric was obtained in the same manner as in Example 1, except that polyester polymer chips with an intrinsic viscosity of 0.50 were used as a raw material for a synthetic fiber multi-filament and the calendering conditions shown in the table were employed.

Comparative Examples 1 and 4

Figure 5:
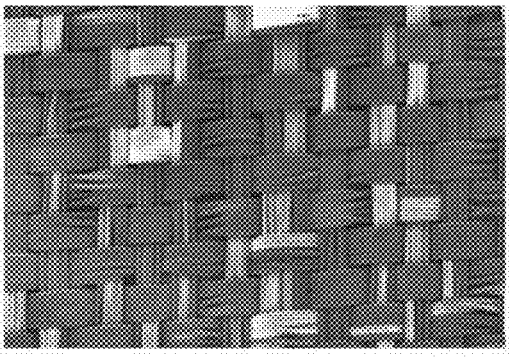
FIG. 5 shows the state of a woven fabric using filaments having a circular cross section.
Figure 5:
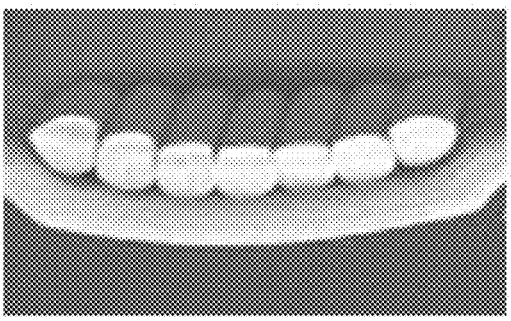
Figure 5:
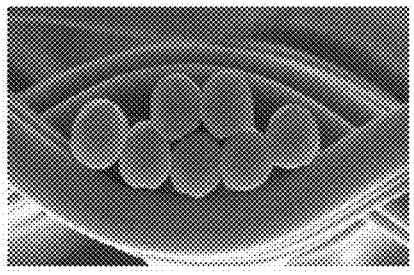

In Comparative Example 1, a woven fabric was obtained in the same manner as in Example 1, except that the diameter of the hole of the spinneret was changed to 0.2 mm and the cross-sectional shape of the filament was changed to a round shape. FIG. 5(*a*) shows an SEM photograph of a surface of the woven fabric obtained in Comparative Example 1; FIG. 5(*b*) shows an SEM photograph of a cross section of the first crossover point in the woven fabric obtained in Comparative Example 1; and FIG. 5(*c*) shows an SEM photograph of a cross section of the second crossover point in the woven fabric obtained in Comparative Example 1. Since the filament in the obtained woven fabric had a round cross-sectional shape, the filament rolled to increase the gaps between the adjacent warp threads and the gaps between the adjacent weft threads, respectively, as shown in FIG. 5(*a*), resulting in giving a rough woven fabric. As a result, the woven fabric showed a low air permeability after ten times washing and an increased value of slipping resistance before and after washing, leading to producing a fabric that had a poor grade of quality and caused distortion during sewing.

In Comparative Example 2, a woven fabric was obtained in the same manner as in Example 1, except that the cross-sectional shape of the filament was changed to a round shape; the number of holes of the spinneret was changed to 20; and the number of the filaments was changed to 20, respectively. The obtained woven fabric had a poor abrasion level because of too many numbers of filaments, as well as had an increased slipping resistance before and after washing, leading to producing a fabric that had a poor grade of quality and caused distortion during sewing.

In Comparative Example 3, a woven fabric was obtained in the same manner as in Example 1, except that the weaving density and the calendering conditions were changed. The obtained woven fabric showed a low air permeability before and after washing, thus the stuffiness (discomfort due to moisture) was felt.

In Comparative Example 4, a woven fabric was obtained in the same manner as in Comparative Example 1, except that the weaving density and the calendering conditions were changed. The obtained woven fabric had a poor abrasion level because of the low weaving density, and the roll of the monofilaments as well as had an increased slipping resistance before and after washing, leading to producing a fabric that had a poor grade of quality and caused distortion during sewing.

TABLE 2

| Item | Unit | Example 1 | Example 2 | Example 3 | Example 4 | Example 5 | Example 6 | Example 7 | Example 8 | Example 9 | Example 10 | Comparative Example 1 | Comparative Example 2 | Comparative Example 3 | Comparative Example 4 |
|---|---|---|---|---|---|---|---|---|---|---|---|---|---|---|---|
| Material | — | Nylon | Nylon | Nylon | Nylon | Nylon | Nylon | Nylo n | Nylon | Nylon | PET | Nylon | Nylon | Nylon | Nylon |
| Total fineness | dtex | 22 | 22 | 22 | 22 | 5.5 | 39 | 22 | 22 | 22 | 22 | 22 | 22 | 22 | 22 |
| Number of filaments | Number of filaments | 7 | 7 | 7 | 7 | 5 | 6 | 7 | 7 | 7 | 7 | 7 | 20 | 7 | 7 |
| Single yarn fineness | dtex/f | 3.1 | 3.1 | 3.1 | 3.1 | 1.1 | 6.5 | 3.1 | 3.1 | 3.1 | 3.1 | 3.1 | 1.1 | 3.1 | 3.1 |
| Cross section of filament | — | Diamond | Diamond | Diamond | Diamond | Diamond | Diamond | Diamond | Square | Parallel-ogram | Diamond | Round | Round | Diamond | Round |
| Angles a and a' | Degrees | 54 | 54 | 54 | 54 | 54 | 54 | 54 | 90 | 54 | 54 | — | — | 54 | — |
| Angles b and b' | Degrees | 126 | 126 | 126 | 126 | 126 | 126 | 126 | 90 | 126 | 126 | — | — | 126 | — |
| Sides A and A' | μm | 18.7 | 18.7 | 18.7 | 18.7 | 14.7 | 24 | 18.7 | 16.6 | 18.7 | 16.7 | — | — | 18.7 | — |
| Sides B and B' | μm | 18.7 | 18.7 | 18.7 | 18.7 | 14.7 | 24 | 18.7 | 16.6 | 28 | 16.7 | — | — | 18.7 | — |
| Weave structure | — | Taffeta | Taffeta | Taffeta | Taffeta | Taffeta | Taffeta | Rip | Taffeta | Taffeta | Taffeta | Taffeta | Taffeta | Taffeta | Taffeta |
| Warp density | threads/ 2.54 cm | 171 | 171 | 171 | 160 | 312 | 250 | 182 | 171 | 171 | 171 | 171 | 171 | 170 | 140 |
| Weft density | threads/ 2.54 cm | 189 | 189 | 189 | 135 | 250 | 145 | 195 | 189 | 189 | 189 | 189 | 189 | 180 | 140 |
| Finishing warp density | threads/ 2.54 cm | 183 | 180 | 183 | 170 | 339 | 260 | 197 | 183 | 183 | 183 | 183 | 183 | 186 | 150 |
| Finishing weft density | threads/ 2.54 cm | 193 | 190 | 193 | 145 | 307 | 155 | 200 | 193 | 193 | 193 | 193 | 193 | 192 | 150 |
| Finishing CF | — | 1763 | 1735 | 1763 | 1477 | 1515 | 2592 | 1862 | 1763 | 1763 | 1763 | 1763 | 1763 | 1772 | 1407 |
| With or without calendering | — | With calender-ing | Without calender-ing | With calender-ing | Without calender-ing | With calender-ing | With calender-ing | With calender-ing | With calender-ing | With calender-ing | With calender-ing | With calendering | With calendering | With calendering | With calendering |
| Calendering pressure | kg/cm | 180 | — | 160 | — | 180 | 150 | 180 | 180 | 180 | 190 | 150 | 150 | 180 | 180 |
| Calendering temperature | ° C. | 160 | — | 70 | — | 180 | 70 | 180 | 180 | 180 | 185 | 180 | 180 | 180 | 160 |
| Calendering frequency | Frequency | 1 | 0 | 1 | 0 | 2 | 1 | 1 | 1 | 1 | 1 | 1 | 1 | 2 | 1 |
| Calendering speed | m/min | 30 | — | 15 | — | 45 | 20 | 30 | 30 | 30 | 15 | 20 | 20 | 20 | 30 |
| Occupancy of first crossover points before washing | % | 50 | 30 | 38 | 28 | 88 | 45 | 44 | 52 | 48 | 43 | 30 | 10 | 90 | 50 |
| Occupancy of second crossover points before washing | % | 50 | 70 | 62 | 72 | 12 | 55 | 56 | 48 | 52 | 57 | 70 | 90 | 10 | 50 |
| Occupancy of first crossover points after ten times washing | % | 45 | 25 | 30 | 15 | 87 | 40 | 36 | 48 | 43 | 38 | 8 | 8 | 88 | 10 |

TABLE 2-continued

| Item | Unit | Example 1 | Example 2 | Example 3 | Example 4 | Example 5 | Example 6 | Example 7 | Example 8 | Example 9 | Example 10 | Comparative Example 1 | Comparative Example 2 | Comparative Example 3 | Comparative Example 4 |
|---|---|---|---|---|---|---|---|---|---|---|---|---|---|---|---|
| Occupancy of second crossover points after ten times | % | 55 | 75 | 70 | 85 | 13 | 60 | 64 | 52 | 57 | 62 | 92 | 92 | 12 | 90 |
| The increase rate of the occupancy of the second crossover points after ten times washing | % | 10.0 | 7.1 | 12.9 | 18.1 | 8.3 | 9.1 | 14.3 | 8.3 | 9.6 | 8.8 | 31.4 | 2.2 | 20.0 | 80.0 |

DESCRIPTION OF REFERENCE SIGNS

A, A', B, B', L1, L2: each represents a length of the side of a substantially quadrilateral shape a, a', b, b': each represents an interior angle of a substantially quadrilateral shape P, Q, R, S: each represents a convex portion T, U, V, W: each represents a concave portion L3: represents a depth of the concave portion

The invention claimed is:

1. A woven fabric comprising:

warp threads constituted by substantially quadrilateral shaped filaments, weft threads constituted by substantially quadrilateral shaped filaments, wherein:

the warp threads and the weft threads overlap each other in an alternating manner forming crossover points comprising front threads and back threads, such that the warp threads and the weft threads alternate constituting the front threads, the crossover points comprise first crossover points and second crossover points, the first crossover points are the crossover points where all the substantially quadrilateral shaped filaments constituting the front threads are aligned in a line, the second crossover points are the crossover points where at least 60% of the substantially quadrilateral shaped filaments constituting the front threads are aligned in a line, and the rest of the substantially quadrilateral shaped filaments constituting the front threads overlap above and below in a thickness direction of the woven fabric, wherein, in a structure constituting five warp threads, six weft threads, and 30 crossover points, the total number of the first crossover points among thirty crossover points is not less than 10% and not more than 90%, and wherein an initial air permeability determined in accordance with the Frazier type method A prescribed in JIS L 1096 8.27.1 is not less than 2.0 $cc/cm^2/s$ and not more than 25 $cc/cm^2/s$.

2. The woven fabric according to claim 1, wherein the substantially quadrilateral shaped filaments have a substantially quadrilateral cross section comprising four sides.

3. The woven fabric according to claim 2, wherein the substantially quadrilateral cross section is a parallelogram wherein each angle in a pair of opposite angles are not less than 30° and not more than 90°.

4. The woven fabric according to claim 2, wherein the substantially quadrilateral cross section is a diamond wherein all four sides are equal in length.

5. The woven fabric according to claim 1, wherein:

the substantially quadrilateral shaped filaments have a fineness of not less than 1.0 dtex and not more than 7.0 dtex;

the woven fabric comprises synthetic fiber multi-filaments constituted by the substantially quadrilateral shaped filaments;

the percentage of the synthetic fiber multi-filaments constituted by the substantially quadrilateral shaped filaments with respect to 100 mass % of the woven fabric is 40 mass % or more; and the synthetic fiber multi-filaments have a total fineness of not less than 5.0 dtex and not more than 40 dtex.

6. The woven fabric according to claim 1, wherein a cover factor is not less than 1450 and not more than 2400.

7. The woven fabric according to claim 1, wherein a rate of change ($L_{10}/L_0$) of an air permeability determined in accordance with the Frazier type method A prescribed in JIS L 1096 8.27.1 between the initial ($L_0$) and the after ten times washing ($L_{10}$) determined in accordance with JIS L 0217 103 method is not less than 0.8 and not more than 1.8.

8. The woven fabric according to claim 1, wherein a slipping resistance value under a load of 12 kg in accordance with JIS L 1096 B method is not more than 4.0 mm in each of warp and weft directions.

9. The woven fabric according to claim 1, wherein an abrasion level after 200 times of abrasion is not lower than level 2.

10. A windbreaker comprising the woven fabric according to claim 1 as an outer fabric.

11. A down product comprising the woven fabric according to claim 1 as an outer fabric.

* * * * *